US009982963B2

(12) United States Patent
Johnson

(10) Patent No.: US 9,982,963 B2
(45) Date of Patent: May 29, 2018

(54) FIREARM HAVING TACTILE BIOFEEDBACK REFERENCE FEATURE

(71) Applicant: Lanny L. Johnson, Frankfort, MI (US)

(72) Inventor: Lanny L. Johnson, Frankfort, MI (US)

( * ) Notice: Subject to any disclaimer, the term of this patent is extended or adjusted under 35 U.S.C. 154(b) by 0 days. days.

(21) Appl. No.: 15/267,006

(22) Filed: Sep. 15, 2016

(65) Prior Publication Data

US 2017/0045325 A1 Feb. 16, 2017

Related U.S. Application Data

(60) Continuation-in-part of application No. 14/689,070, filed on Apr. 17, 2015, which is a continuation of application No. 14/333,664, filed on Jul. 17, 2014, now Pat. No. 9,011,279, which is a division of application No. 13/772,005, filed on Feb. 20, 2013.
(Continued)

(51) Int. Cl.

| | |
|---|---|
| ***F41C 23/16*** | (2006.01) |
| ***A63B 60/10*** | (2015.01) |
| ***F42B 6/00*** | (2006.01) |
| ***F41C 23/10*** | (2006.01) |
| ***A63B 69/38*** | (2006.01) |
| ***A63D 15/08*** | (2006.01) |
| ***A63B 60/48*** | (2015.01) |
| ***A63B 60/52*** | (2015.01) |
| ***A63B 59/40*** | (2015.01) |
| ***A63B 60/06*** | (2015.01) |
| ***A63B 60/08*** | (2015.01) |
| *A63B 71/06* | (2006.01) |
| *A63B 102/16* | (2015.01) |

(52) U.S. Cl.
CPC ..... *F41C 23/16* (2013.01); *A63B 59/40* (2015.10); *A63B 60/06* (2015.10); *A63B 60/08* (2015.10); *A63B 60/10* (2015.10); *A63B 60/48* (2015.10); *A63B 60/52* (2015.10); *A63B 69/38* (2013.01); *A63D 15/08* (2013.01); *F41C 23/10* (2013.01); *F42B 6/003* (2013.01); *A63B 2071/0655* (2013.01); *A63B 2102/16* (2015.10)

(58) Field of Classification Search
CPC ..... A63B 53/14; A63B 60/08; A63B 60/10; A63B 60/06; A63B 69/3632
USPC ..... 42/71.01–74; 473/300, 303, 513
See application file for complete search history.

(56) References Cited

U.S. PATENT DOCUMENTS

| | | | |
|---|---|---|---|
| 242,877 | A | 6/1881 | Bryant |
| 729,639 | A | 6/1903 | McCoy |

(Continued)

FOREIGN PATENT DOCUMENTS

| | | |
|---|---|---|
| EP | 1452208 A1 | 9/2004 |
| JP | 2003180892 | 7/2003 |

OTHER PUBLICATIONS

International Search Report and Written Opinion of the International Searching Authority for International Application No. PCT/US2011/204453 dated Apr. 5, 2011, 12 pages.

*Primary Examiner* — Michael D David
(74) *Attorney, Agent, or Firm* — Gallagher & Dawsey Co., LPA; David J. Dawsey; Michael J. Gallagher

(57) ABSTRACT

A firearm that provides a user with tactile biofeedback. The firearm includes a tactile reference feature that extends longitudinally along an exterior body surface and is formed with dimensions specifically tailored to harness the user's natural attributes of sensibility, proprioception, and neuromuscular memory to improve a user's accuracy.

19 Claims, 29 Drawing Sheets

Related U.S. Application Data

(60) Provisional application No. 61/601,075, filed on Feb. 21, 2012.

(56) References Cited

U.S. PATENT DOCUMENTS 774,621 A 11/1904 Van Setres
834,711 A 10/1906 Clarke
878,524 A 2/1908 Gregory
1,025,478 A 5/1912 Murphy
1,149,834 A 8/1915 James
1,488,900 A 4/1924 Armstrong
1,556,781 A 10/1925 Emil
1,587,082 A 6/1926 Mattern
1,604,696 A 10/1926 Jordy
2,099,521 A 11/1937 Herkimer et al.
2,166,044 A 7/1939 Lewthwaith et al.
D128,266 S 7/1941 Smith
2,270,707 A * 1/1942 Humski ..... F41G 1/00 33/262
2,280,382 A 4/1942 Davis
D160,396 S 10/1950 Karns
D172,416 S 6/1954 Brandon
D173,110 S 9/1954 Karns
D174,183 S 3/1955 Karns
2,832,166 A 4/1958 Ivy
2,871,899 A 2/1959 Coyle et al.
2,983,512 A 5/1961 Fleischer
3,109,653 A 11/1963 Biggs
D210,468 S 3/1968 Brewer
3,606,326 A 9/1971 Sparks
3,706,453 A 12/1972 Rosasco
3,815,270 A 6/1974 Pachmayr
4,043,066 A 8/1977 Pachmayr et al.
4,134,588 A 1/1979 Di Luzio
4,222,562 A 9/1980 Gardner
4,346,530 A 8/1982 Stewart et al.
D269,895 S 7/1983 Bianchi et al.
4,466,610 A 8/1984 Isreal
4,537,403 A 8/1985 Farina
4,613,537 A 9/1986 Krupper
D295,207 S 4/1988 Mahaffey
4,795,158 A 1/1989 Kuykendall
D307,169 S 4/1990 Aldridge
4,919,420 A 4/1990 Sato
4,932,659 A 6/1990 Freeberg
4,936,036 A 6/1990 Sniezak et al.
4,949,965 A 8/1990 Ross, Jr. et al.
4,967,503 A 11/1990 Farrar
4,974,846 A 12/1990 Fenton
5,087,042 A 2/1992 Solheim
5,133,555 A 7/1992 Bailey
5,152,533 A 10/1992 Radakovich
5,158,297 A 10/1992 Johnson
5,165,681 A 11/1992 Enger et al.
5,193,246 A 3/1993 Huang
5,217,380 A 6/1993 Martinet
5,231,237 A 7/1993 Cupp
5,248,141 A 9/1993 Kelly
5,273,293 A 12/1993 Lekavich
5,279,060 A 1/1994 Watson
D344,124 S 2/1994 Cupp
D345,192 S 3/1994 Solheim
D349,938 S 8/1994 Hogue et al.
5,348,303 A 9/1994 Swissheim
D357,295 S 4/1995 Solheim
5,465,520 A 11/1995 Cupp
5,558,584 A 9/1996 Brown
5,560,136 A 10/1996 Cupp
5,575,724 A 11/1996 Hannon et al.
D376,400 S 12/1996 Nakazaki
5,590,437 A 1/1997 McMillin
5,621,997 A 4/1997 Pearce
5,634,859 A 6/1997 Nesbitt
5,637,043 A 6/1997 Fortis
5,704,842 A 1/1998 Petrusek
D391,330 S 2/1998 Solheim
5,768,817 A 6/1998 Simons
5,788,582 A 8/1998 Shapiro
5,788,588 A 8/1998 Hooker
5,797,207 A 8/1998 Marable et al.
5,842,300 A * 12/1998 Cheshelski ..... F41A 33/02 42/116
5,897,440 A 4/1999 Bae et al.
6,022,278 A 2/2000 Vela
6,073,381 A 6/2000 Farrar et al.
D431,851 S 10/2000 Anderson
6,129,642 A 10/2000 Tigny
D435,074 S 12/2000 Dunham
6,155,930 A 12/2000 Madara
6,500,079 B1 12/2002 Tucker, Sr.
6,591,456 B2 7/2003 Deluca et al.
6,595,880 B2 7/2003 Becker
6,605,005 B1 8/2003 Lin
6,609,981 B2 8/2003 Hirata
6,656,054 B2 12/2003 Ulrich
6,656,057 B2 12/2003 Manual et al.
6,718,675 B1 4/2004 Lu
6,746,336 B1 6/2004 Brant et al.
6,758,760 B1 7/2004 Kellogg et al.
6,802,907 B2 10/2004 Slobodkin
6,840,869 B2 1/2005 Chen
6,908,400 B2 6/2005 Chu et al.
6,921,340 B2 7/2005 Dickie
6,929,555 B2 8/2005 Morton
6,964,382 B2 11/2005 Alexander et al.
D512,758 S 12/2005 Tuerschmann et al.
6,974,626 B2 12/2005 Horacek
7,175,538 B2 2/2007 Miller
7,201,678 B2 4/2007 Filice et al.
D548,807 S 8/2007 Miller
D548,808 S 8/2007 Chen
7,287,455 B2 10/2007 Key-Carniak et al.
D560,750 S 1/2008 Potter
7,326,135 B2 2/2008 Lussier et al.
7,351,167 B1 4/2008 Hathaway
7,371,196 B2 5/2008 Morrow et al.
7,416,499 B2 8/2008 Tucker et al.
7,485,050 B2 2/2009 Rose
7,537,525 B2 5/2009 Wang
7,637,821 B2 12/2009 Johnson
7,748,153 B2 7/2010 Beretta
7,776,004 B2 8/2010 Yarger
7,789,777 B2 9/2010 Tucker et al.
7,794,332 B2 9/2010 Johnson
7,874,181 B1 1/2011 Lindahl
7,937,874 B2 5/2011 Roth
7,967,188 B2 6/2011 Hickox
7,972,227 B2 7/2011 Lamson
3,062,147 A1 11/2011 Johnson
8,092,317 B2 1/2012 Johnson
8,181,378 B2 5/2012 Losinger
8,267,806 B2 9/2012 Karube
8,782,937 B2 * 7/2014 Grossman ..... F41A 17/46 42/1.01
2002/0072423 A1 6/2002 Pot
2002/0169031 A1 11/2002 Wallace et al.
2003/0013539 A1 1/2003 Scott et al.
2003/0034366 A1 2/2003 Sloan
2003/0083142 A1 5/2003 Nam
2003/0134088 A1 7/2003 Chen et al.
2004/0005932 A1 1/2004 Kuo
2004/0077428 A1 4/2004 Oliver et al.
2004/0116196 A1 6/2004 Nazaruk
2004/0185955 A1 9/2004 Rocconi
2004/0192458 A1 9/2004 Daniels
2004/0224781 A1 11/2004 Davtyan et al.
2004/0259655 A1 12/2004 Ferris
2004/0259657 A1 12/2004 Heller et al.
2005/0026712 A1 2/2005 Byrd et al.
2005/0187030 A1 8/2005 Miller
2006/0030418 A1 2/2006 Evans et al.
2006/0068148 A1 3/2006 Ulrich

(56) References Cited

U.S. PATENT DOCUMENTS

2006/0156608 A1* 7/2006 Kellermann ..... F41A 3/66 42/71.02
2006/0212056 A1 9/2006 Salvadori et al.
2006/0287124 A1 12/2006 Han et al.
2007/0082569 A1 4/2007 Gorres
2007/0082748 A1 4/2007 Rose
2007/0129186 A1 6/2007 Appleton
2007/0148409 A1 6/2007 Rios et al.
2007/0259732 A1 11/2007 Billings et al.
2008/0020166 A1 1/2008 Esposito et al.
2008/0102974 A1 5/2008 Nam
2008/0105246 A1 5/2008 Marques et al.
2008/0176685 A1 7/2008 Madore et al.
2008/0230174 A1 9/2008 Huang
2008/0305883 A1 12/2008 Cameron
2009/0017935 A1 1/2009 Wang et al.
2009/0023512 A1 1/2009 Watson
2009/0082122 A1 3/2009 Kellogg
2009/0162596 A1 6/2009 Rios et al.
2009/0170641 A1 7/2009 Qin et al.
2009/0217631 A1 9/2009 Pepin et al.
2009/0239689 A1 9/2009 Baxter et al.
2009/0253528 A1 10/2009 Brolly
2009/0258195 A1 10/2009 Lauer
2010/0009787 A1 1/2010 Vacek et al.
2010/0011483 A1 1/2010 Pinkart
2010/0102479 A1 4/2010 Wallis
2010/0183814 A1 7/2010 Rios et al.
2010/0281741 A1 11/2010 Gibson et al.
2010/0317469 A1 12/2010 Comelle et al.
2011/0107642 A1* 5/2011 Godard ..... F41C 23/10 42/71.01
2011/0167698 A1 7/2011 Hoguc
2012/0034993 A1 2/2012 Johnson
2013/0217523 A1* 8/2013 Johnson ..... F42B 6/003 473/516

* cited by examiner

FIREARM HAVING TACTILE BIOFEEDBACK REFERENCE FEATURE

CROSS-REFERENCE TO RELATED APPLICATIONS

This application is a continuation-in-part of U.S. patent application Ser. No. 14/689,070, filed on Apr. 17, 2015, which is a continuation application of U.S. patent application Ser. No. 14/333,664, filed on Jul. 17, 2014, which is a divisional application of U.S. patent application Ser. No. 13/772,005, now abandoned, filed on Feb. 20, 2013, which claims the benefit of U.S. provisional patent application Ser. No. 61/601,075, filed on Feb. 21, 2012, all of which are incorporated by reference as if completely written herein.

TECHNICAL FIELD

The present disclosure relates to the field of sports equipment, and more particularly, to sports equipment that provides a user with tactile biofeedback.

BACKGROUND OF THE INVENTION

The sports equipment handle, or interface between a piece of sports equipment and human skin, is perhaps the most overlooked and underappreciated piece of sports equipment, or interfaces, that can be improved for better performance. Sports equipment handle, and contact/interface, technology has changed very little over the past few decades.

For the most part, the sports equipment handle and/or the contact interface has not been considered as a means for game improvement. Rather, the sports industry has primarily focused on the impact head of a racquet or paddle, cue tip, materials of construction, aerodynamics, and projectile advancements as the sole means for helping improve an athlete's game. Many modern racquets, paddles, and bats are designed to be more forgiving when an athlete does not hit the ball in the sports equipment's sweet spot, or makes an errant throw. However, modern racquets, paddle heads, cue sticks, bat bodies, dart bodies, and archery/firearm designs do very little to help an athlete consistently hit the ball in the sports equipment's sweet spot or make consistent accurate shots or throws.

Interestingly, the sports industry has ignored the only physical connection between the athlete and the sports equipment (i.e., the sports equipment handle or contact interface in the case of shoes and skates) as a vehicle for solving the problem of an athlete's performance. The presently disclosed sport equipment handle and/or contact interface solves the problem by providing at least one tactile structure that harnesses the innate attributes and processes of the athlete's body.

SUMMARY OF INVENTION

In its most general configuration, the presently disclosed sport equipment handle, contact interface, and/or tactile attachment advances the state of the art with a variety of new capabilities and overcomes many of the shortcomings of prior devices in new and novel ways. The presently disclosed sport equipment handle, contact interface, and/or tactile attachment overcomes the shortcomings and limitations of the prior art in any of a number of generally effective configurations. The presently disclosed sport equipment handle, contact interface, and/or tactile attachment demonstrates such capabilities and overcomes many of the shortcomings of prior methods in new and novel ways.

The present disclosure relates to a sport equipment handle, contact interface, and/or tactile attachment that provides a user with tactile biofeedback. The sport equipment handle may include a handle body having an upper portion, a lower portion, a handle length, a proximal end, a distal end, and an exterior body surface. The exterior body surface is defined by a first octant, a second octant, a third octant, a fourth octant, a fifth octant, a sixth octant, a seventh octant, and an eighth octant. The sports equipment handle, contact interface, and/or tactile attachment includes at least a tactile reference indentation or projection that extends longitudinally along a surface. The tactile reference indentation or projection is formed with dimensions specifically tailored to harness the user's natural attributes of sensibility, proprioception, and neuromuscular memory to enable the user to consistently hit a projectile with accuracy, throw a projectile with accuracy, shoot a projectile with accuracy, or improve an athlete's ability to sense the location and placement of a body part.

BRIEF DESCRIPTION OF THE DRAWINGS

Without limiting the scope of the sports equipment handle and system as claimed below and referring now to the drawings and figures:

FIG. 1 (B) is a front elevation view of an embodiment of a sports equipment handle on a baseball bat, not to scale;

Figure 1:
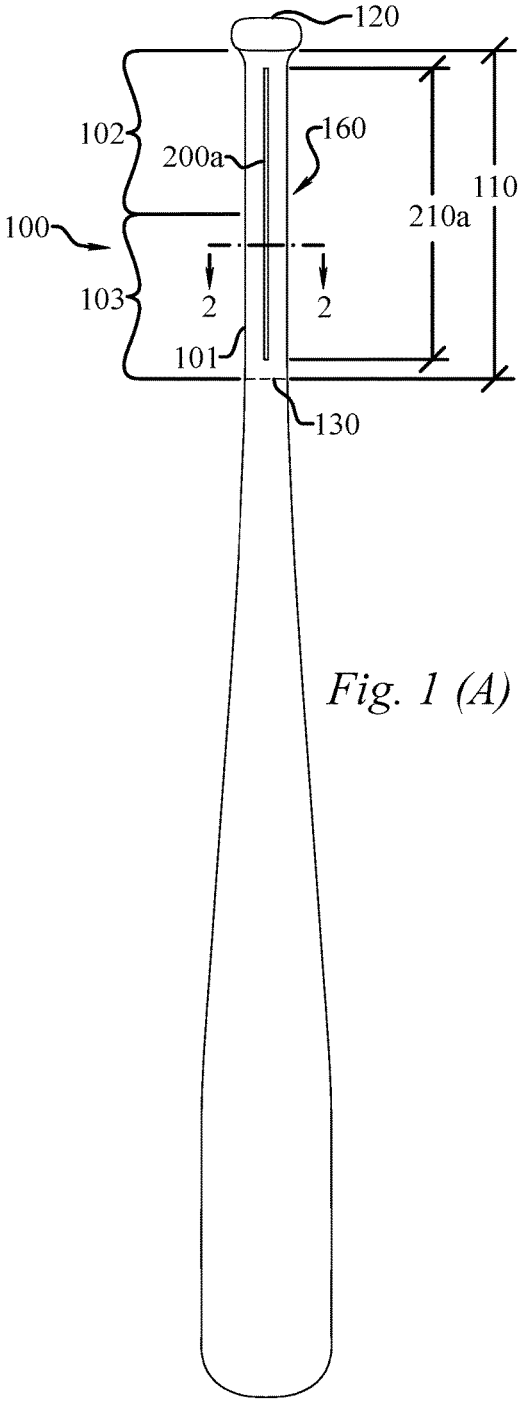
FIG. 1 (A) is a front elevation view of an embodiment of a sports equipment handle on a baseball bat, not to scale.
Figure 1:
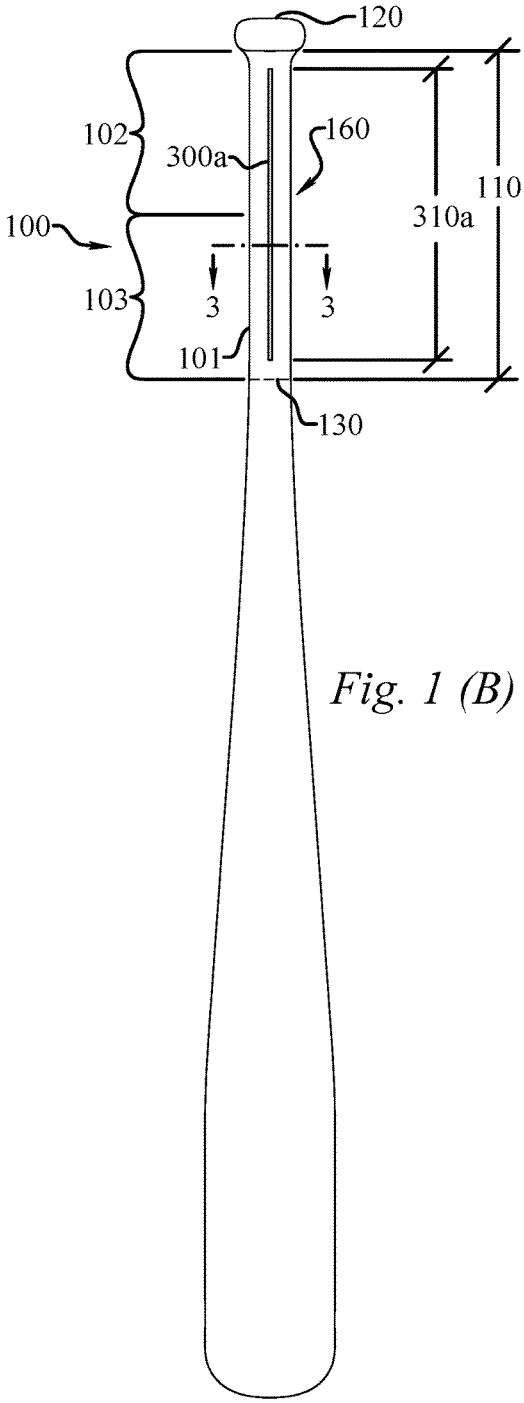

These drawings are provided to assist in the understanding of the exemplary embodiments of the presently disclosed sports equipment handle as described in more detail below and should not be construed as unduly limiting the sports equipment handle and system. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

A sports equipment handle (100), contact interface, or tactile reference attachment (700) that provides a user with tactile biofeedback enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the sports equipment handle (100), contact interface, or tactile reference attachment (700), and is not intended to represent the only form in which the present sports equipment handle (100), contact interface, or tactile reference attachment (700) may be constructed or utilized. The description sets forth the designs, functions, means, and methods of gripping the sports equipment handle (100), contact interface, or tactile reference attachment (700) in connection with the illustrated embodiments. It is to be understood, however, that the same or equivalent functions and features may be accomplished by different embodiments that are also intended to be encompassed within the spirit and scope of the sports equipment handle (100), contact interface, or tactile reference attachment (700).

FIGS. 1-46 illustrate numerous embodiments of a sports equipment handle (100), contact interface, and/or tactile reference attachment (700) to provide a user with tactile biofeedback. The sports equipment handle (100), contact interface, and/or tactile reference attachment (700) includes at least one tactile structure specifically tailored to exploit and harness the innate attributes and processes of the human body to allow the user to consistently hit, throw, or shoot a projectile with accuracy. It is worth noting at the outset of this section that all of the disclosure related to the tactile reference indentations (200, 200*a*, 200*b*, 200*c*, 200*d*) and the tactile reference projections (300, 300*a*, 300*b*, 300*c*, 300*d*) applies to embodiments where the indentations or projections are formed in, or on, a piece of sports equipment, as seen in FIGS. 1-30, and also when the indentations or projections are formed in, or on, a tactile reference attachment (700), as seen in FIGS. 31-46. Thus, all attributes disclosed with respect to embodiments of FIGS. 2-9 are also applicable to embodiments in which the indentations or projections are formed in, or on, a tactile reference attachment (700), as seen in FIGS. 31-46, including, but not limited to, length, width, depth, height, wall and edge configurations, cross-sectional shape, placement, etc., and will not be repeated separately for tactile reference attachment (700) embodiments.

Figure 31:
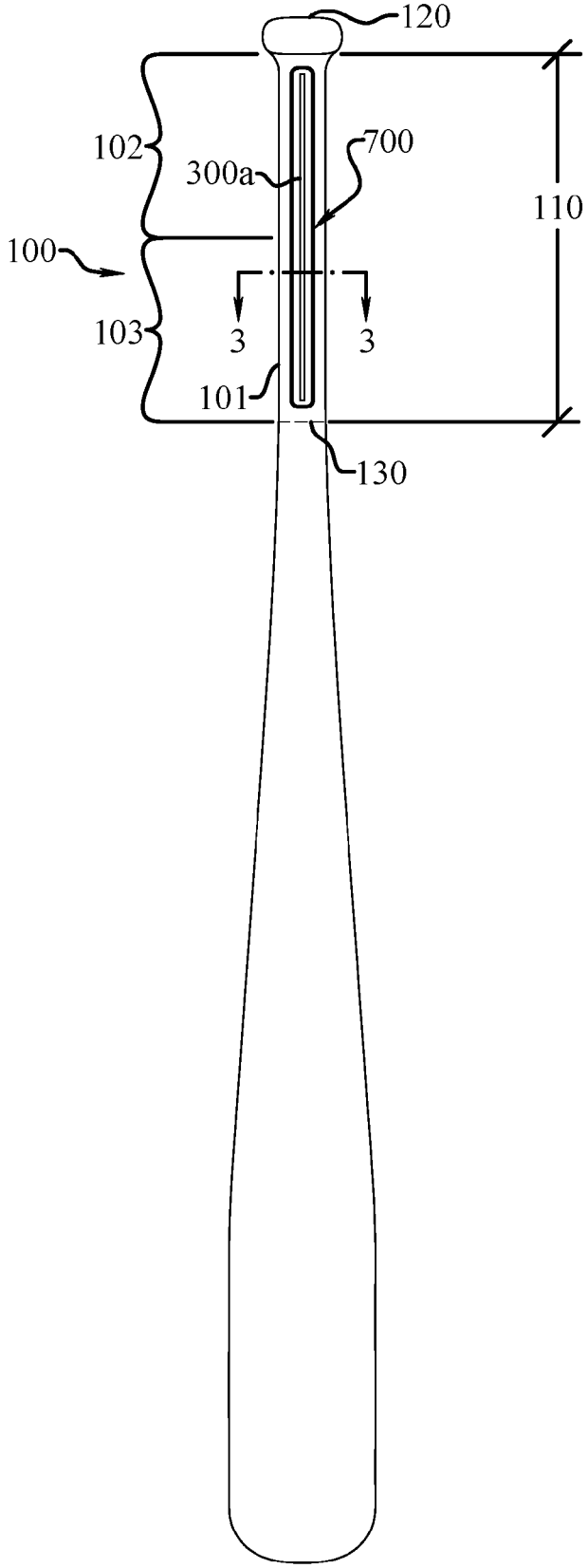
FIG. 31 is a front elevation view of an embodiment of a sports equipment handle on a baseball bat, not to scale.

Referring now to FIGS. 1(A), 1(B), and 31, an embodiment of a sports equipment handle (100) on a baseball bat is illustrated. As seen in FIG. 1(A), the sports equipment handle (100) includes a handle body (101) having an upper portion (102), a lower portion (103), a handle length (110), a proximal end (120), a distal end (130), and an exterior body surface (160). The upper portion (102) and the lower portion (103) correspond to the portion of the handle body (101) that is above the midpoint of the handle length (110) and below the midpoint of the handle length (110), respectively. Generally, for a right-handed user using a conventional gripping style, the upper portion (102) is where a majority of the user's left hand would grasp the sports equipment handle (100) and the lower portion (103) is where a majority of the user's right hand would grasp the sports equipment handle (100).

Figure 2:
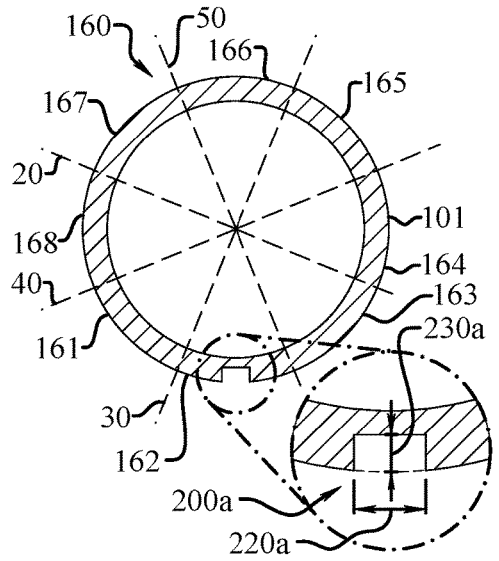
FIG. 2 is a cross-sectional view of the embodiment of the sports equipment handle taken along section line 2-2, not to scale.

As seen in FIG. 2, in this embodiment the handle body (101) has a substantially circular cross-section throughout the handle length (110), however the present invention is not limited to circular handles. The exterior body surface (160) is defined by a first octant (161), a second octant (162), a third octant (163), a fourth octant (164), a fifth octant (165), a sixth octant (166), a seventh octant (167), and an eighth octant (168). The octants (161, 162, 163, 164, 165, 166, 167, 168) are defined by the intersection of four imaginary vertical planes (20, 30, 40, 50), with each vertical plane (20, 30, 40, 50) spaced 45 degrees from the adjacent vertical planes (20, 30, 40, 50), as seen well in FIG. 2. Preferably, the four imaginary vertical planes (20, 30, 40, 50) intersect at the geometric center of the proximal end (120), i.e., the butt end, of the sports equipment handle (100); however the planes may be positioned to pass the a cross-sectional centroid of the handle. The four imaginary vertical planes (20, 30, 40, 50) may be rotated about the geometric center of the proximal end (120) to define a position of the octants (161, 162, 163, 164, 165, 166, 167, 168). Moreover, the sports equipment handle (100) may include visual indicia, such as painted lines, on the exterior body surface (160) that visually delineates the octants (161, 162, 163, 164, 165, 166, 167, 168). The tactile reference indentations (200) illustrated in FIGS. 2, 4, 6, and 8 have flat sidewalls and a flat bottom, but this is not necessary, and may be formed in the sports equipment handle (100) or may be formed in a tactile reference attachment (700), as seen in FIGS. 31-46 and disclosed later in great detail. The tactile reference indentation(s) may have a "V" shaped cross-section or even a curved bottom cross-section, it is more important that the surface edges of the tactile reference indentations (200) have very small, or no, radius of curvature so that the edges are very distinct. In one embodiment, radius of curvature from the indentation (200) sidewall to the adjacent handle, grip, or tactile reference attachment (700) surface is 0.35 millimeters or less. Such a dimension for the radius of curvature accommodates two-point discrimination by making the edge relatively fine and thus capable of distinction by feel. In another embodiment this radius of curvature is zero, meaning that the indentation and the adjacent handle, grip, or tactile reference attachment (700) surface, meet at a distinct line. In an even further embodiment, and as illustrated in FIG. 2, the indentation (200) sidewalls meet the adjacent handle, grip, or tactile reference attachment (700) surface at substantially a 90 degree angle.

As seen in the embodiment of FIG. 1(A), the sports equipment handle (100) includes at least a tactile reference indentation (200*a*) extending longitudinally along the exterior body surface (160), and may be formed in the sports equipment handle (100) or may be formed in a tactile reference attachment (700), as seen in FIGS. 31-46. The tactile reference indentation (200*a*) has a tactile reference indentation length (210*a*), a tactile reference indentation width (220*a*), and a tactile reference indentation depth (230*a*), as seen in FIGS. 1(A) and 2; and all of this disclosure applies equally to the tactile reference attachment (700) embodiments seen in FIGS. 31-46. The tactile reference indentation (200*a*) is confined to a first tactile octant selected from the group consisting of the first octant (161), the second octant (162), the third octant (163), the fourth octant (164), the fifth octant (165), the sixth octant (166), the seventh octant (167), and the eighth octant (168). In the embodiment of FIG. 2 the first tactile octant is the second octant (162) and the tactile reference indentation (200*a*) is confined to the second octant (162). However, the first tactile octant may be the first octant (161), the third octant (163), the fourth octant (164), the fifth octant (165), the sixth octant (166), the seventh octant (167), or the eighth octant (168).

In this particular embodiment, there is only the tactile reference indentation (200*a*) in the first tactile octant. It should be noted that while this particular embodiment includes "only" the tactile reference indentation (200*a*) in the first tactile octant, this does not mean that the exterior body surface (160) cannot have additional surface patterns, texture changes, or other similar features. When the term "only" is used in connection with describing a tactile reference indentation (200*a*) in certain tactile octants (i.e., "there is only the tactile reference indentation (200*a*) in the first octant"), it means that the tactile octants do not contain any additional palpable indicia adjacent to the tactile reference indentation (200*a*). The term palpable indicia, as used throughout this specification, means a structure having a depth or height of at least 0.4 millimeters, a width of at least 1.0 millimeters, and a length of at least 25 millimeters.

Figure 3:
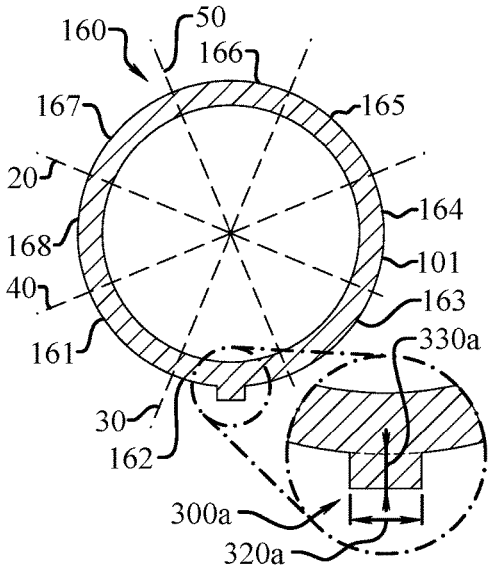
FIG. 3 is a cross-sectional view of an embodiment of a sports equipment handle taken along section line 3-3, not to scale.

In another embodiment of the sports equipment handle (100), the sports equipment handle (100) may include a tactile reference projection (300*a*) extending longitudinally along the exterior body surface (160), as seen in FIGS. 1 (B) and 3, and may be formed in the sports equipment handle (100) or may be formed in a tactile reference attachment (700), as seen in FIGS. 31-46. The tactile reference projection (300*a*) has a tactile reference projection length (310*a*), tactile reference projection width (320*a*), and a tactile reference projection height (330*a*), as seen in FIG. 3; and all of this disclosure applies equally to the tactile reference attachment (700) embodiments seen in FIGS. 31-46. The tactile reference projection (300*a*) is confined to a first tactile octant selected from the group consisting of the first octant (161), the second octant (162), the third octant (163), the fourth octant (164), the fifth octant (165), the sixth octant (166), the seventh octant (167), and the eighth octant (168). As seen in FIG. 3, in this embodiment the first tactile octant is the second octant (162) and the tactile reference projection (300*a*) is confined to the second octant (162). However, the first tactile octant may also be the first octant (161), the third octant (163), the fourth octant (164), the fifth octant (165), the sixth octant (166), the seventh octant (167), or the eighth octant (168). The tactile reference projections (300) illustrated in FIGS. 3, 5, 7, and 9 have flat sidewalls and a flat top, but this is not necessary. The tactile reference projections may have virtually any cross-sectional shape provided that the outermost surface has two relatively well defined longitudinal edges. In other words, while the intersection of the sidewall surfaces to the adjacent handle, or grip, may be smooth and nondistinct, it is more important that the edges along the outermost surface of the tactile reference projections (300) have very small, or no, radius of curvature so that the edges are very distinct. In one embodiment, radius of curvature from the projection (300) sidewall to the outermost surface of the projection (300) is 0.35 millimeters or less. Such a dimension for the radius of curvature accommodates two-point discrimination by making the edge relatively fine and thus capable of distinction by feel. In another embodiment this radius of curvature is zero, meaning that the projection and the adjacent projection sidewall meet at a distinct line. In an even further embodiment, and as illustrated in FIG. 3, the projection (300) sidewalls meet the adjacent outermost surface at substantially a 90 degree angle.

In this particular embodiment, as seen in FIG. 3, there is only the tactile reference projection (300*a*) in the first tactile octant. It should be noted that while this particular embodiment includes "only" the tactile reference projection (300*a*) in the first tactile octant, this does not mean that the exterior body surface (160) cannot have additional surface patterns, texture changes, or other similar features. When the term "only" is used in connection with describing a tactile reference projection (300*a*) in certain tactile octants (i.e., "there is only the tactile reference projection (300*a*) in the first octant"), it means that the tactile octants do not contain any additional palpable indicia adjacent the tactile reference projection (300*a*).

Regardless of whether formed in the sports equipment handle (100), as seen in FIGS. 1-30, the tactile reference attachment (700), as seen in FIGS. 31-46, or a contact interface such as the interior of a shoe or skate, the tactile reference indentation width (220*a*) and the tactile reference projection width (320*a*) are at least 2.0 millimeters and no greater than 5.0 millimeters, and the tactile reference indentation depth (230*a*) and tactile reference projection height (330*a*) are at least 0.5 millimeters. These specific dimensions are important because they exploit several of the user's normal human body attributes to enable the user to consistently grip a sports equipment handle (100) and recognize the position of the handle in space, thereby improving a user's ability to hit, throw, or shoot a projectile with accuracy. The sports equipment handle (100), contact interface, and/or the tactile reference attachment (700) enhances users' perception and awareness of the "spatial" relationship of the instrument attached to the handle (100), or a portion of the user's body, allowing for improved performance. These attributes include sensibility, proprioception, and neuromuscular memory.

Sensibility is the body's ability to determine fine objects by feel. This ability is measured by what is known as two-point discrimination. Two-point discrimination is defined as the ability to discern that two nearby objects touching the skin are truly two distinct points, not one. The test for two-point discrimination is usually performed utilizing two sharp points. Typically, a person has the most sensibility on their finger pads and lips. A normal measurement for two-point discrimination on the finger pads is a width of 2.0 millimeters to 5.0 millimeters, while other body parts, such as the back, have much larger measurements due to less nerve endings. When the two points are closer together than the range of two-point discrimination a person cannot tell whether they are being contacted by one point or two points.

Proprioception is the unconscious perception of movement and spatial orientation arising from stimuli within the body itself. For humans, these stimuli are detected by nerves within the body, such as in joints, tendons, and muscles. A practical example of proprioception is the ability to close one's eyes and touch the index fingers of both hands together without looking. As a result of proprioception, the human body has the ability to know exactly where it is in space. The human body also has the ability to remember and repeat past movements, which are referred to as neuromuscular memory. As sensations are recorded by the body and movements are repeated over time, the body develops an ability to repeat movements without conscious effort.

A user's connection to a piece of sports equipment is established by what they perceive at the point that they are griping the piece. The presently disclosed sports equipment handle (100), contact interface, and/or the tactile reference attachment (700), harnesses a user's sensibility by providing at least a tactile reference indentation (200*a*) or tactile reference projection (300*a*) extending longitudinally along the exterior body surface (160) of the sports equipment handle (100) to create an intimate connection between at least one of the user's hands and the sports equipment handle (100). As previously mentioned, the tactile reference indentation width (220*a*) and the tactile reference projection width (320*a*) is at least 2.0 millimeters and no greater than 5.0 millimeters, regardless of whether formed in the sports equipment handle (100) or the tactile reference attachment (700), as seen in FIGS. 31-46, which, importantly, corresponds to the normal range for two-point discrimination on the finger pads, thumb, and/or palm to provide the user with tactile biofeedback. Moreover, most humans do not have the ability to perceive a structure having a depth of less than 0.5 millimeters and a width of less than 2.0 millimeters with the finger pads, thumb, and/or palm. As a result, providing at least a tactile reference indentation (200*a*) or tactile reference projection (300*a*) extending longitudinally along the exterior body surface (160), or the surface of the tactile reference attachment (700), with a tactile reference indentation width (220*a*) or tactile reference projection width (320*a*) of at least 2.0 millimeters and no greater than 5.0 millimeters and a tactile reference indentation depth (230*a*) or tactile reference projection height (330*a*) of at least 0.5 millimeters, which provides the highest level of sensibility, allows the finger pads, thumb, and/or palm to function as high level neurological information collectors. In a further embodiment the tactile reference indentation width (220*a*) or tactile reference projection width (320*a*) is 2.0-4.0 millimeters and the tactile reference indentation depth (230*a*) or tactile reference projection height (330*a*) is 0.5-4.0 millimeters; while in an even further embodiment the tactile reference indentation width (220*a*) or tactile reference projection width (320*a*) is 2.0-3.0 millimeters and the tactile reference indentation depth (230*a*) or tactile reference projection height (330*a*) is 0.5-3.0 millimeters. In still a further embodiment the tactile reference indentation width (220*a*) or tactile reference projection width (320*a*) is at least twice the tactile reference indentation depth (230*a*) or tactile reference projection height (330*a*); while in yet another embodiment the tactile reference indentation width (220*a*) or tactile reference projection width (320*a*) is at least three times the tactile reference indentation depth (230*a*) or tactile reference projection height (330*a*). In yet another embodiment the tactile reference indentation width (220*a*) or tactile reference projection width (320*a*) is at least 2-6 times the tactile reference indentation depth (230*a*) or tactile reference projection height (330*a*); while in yet another embodiment the tactile reference indentation width (220*a*) or tactile reference projection width (320*a*) is 3-5 times the tactile reference indentation depth (230*a*) or tactile reference projection height (330*a*). In still a further embodiment the tactile reference indentation depth (230*a*) or tactile reference projection height (330*a*) is no more than the tactile reference indentation width (220*a*) or tactile reference projection width (320*a*). All ranges and relationships disclosed herein with respect to one tactile reference indentation or projection, are equally applicable to other disclosed indentations and projections but will not be repeated for the sake of brevity.

The finger pads, thumb, and/or palm, as high level neurological information collectors, are able to recognize the location and orientation of the tactile reference indentation (200*a*) or the tactile reference projection (300*a*), which is in the same spatial relationship as the sports equipment handle. In sports in which the players typically wear gloves the tactile reference indentation depth (230*a*) or tactile reference projection height (330*a*) may be increased to overcome the loss of sensitivity as a result of the glove layer. In one embodiment directed to gloved sports the tactile reference indentation depth (230*a*) or tactile reference projection height (330*a*) is at least 1.0 millimeter, and more preferably at least 2.0 millimeters; while in a further embodiment the tactile reference indentation depth (230*a*) or tactile reference projection height (330*a*) is 1.0-4.0 millimeter, and more preferably 1.0-3.0 millimeters. Each of the disclosed ranges and relationships is critical to improved performance by aligning the characteristics of the indentations or projections with the high level discrimination on the finger pads, thumb, and/or palm to provide the user with tactile biofeedback and harness a user's sensibility to create an intimate connection between at least one of the user's hands and the piece of equipment with improved proprioception, thereby affording the user the ability to know exactly where the piece of equipment is in space. Due to the intimate connection and the high level of sensibility provided by the specifically tailored tactile reference indentation (200*a*) or the tactile reference projection (300*a*) of the sports equipment handle (100), contact interface, or the surface of the tactile reference attachment (700), the sports equipment becomes like an extension of the user's body. At this point, the user's natural ability of proprioception is engaged, which allows the user to unconsciously perceive and spontaneously direct the sports equipment's movement in space due to the high level of sensibility provided by tactile reference indentation (200*a*) or the tactile reference projection (300*a*) extending longitudinally along the exterior body surface (160) of the sports equipment handle (100). As a result, the user will know where the sports equipment, which may include shoes and skates, is in space and can make conscious, or even unconscious, adjustments to ensure that the projectile is consistently hit, thrown, or shot with accuracy, or a portion of the user's body is positioned as desired.

Additionally, the sports equipment handle (100), contact interface, and the tactile reference attachment (700) build upon the beneficial attributes provided by the high level of sensibility and proprioception by utilizing the user's natural capacity for neuromuscular memory. When a user grasps the sports equipment handle (100), the surface of the tactile reference attachment (700), or engages the contact interface, and makes a swing, throw, or aligns to take a shot, the user obtains neuromuscular memory from the sensations recorded in the hands via the tactile reference indentation (200*a*) or the tactile reference projection (300*a*), in addition to registering the entire body's spatial relationships through proprioception. This information is stored and fed back through the body to the hands so the various muscles and joints are able to repeat the recorded performance to be transferred to the sports equipment via the sports equipment handle (100), and in some embodiments the surface of the tactile reference attachment (700). As a result, the sports equipment handle (100), and/or the surface of the tactile reference attachment (700), allows the user to build neuromuscular memory to consistently strike, throw, or shoot a projectile with increased accuracy. The tactile reference indentation (200*a*) or the tactile reference projection (300*a*) provide heightened neurosensory input to facilitate proprioception and muscle memory.

Figure 10:
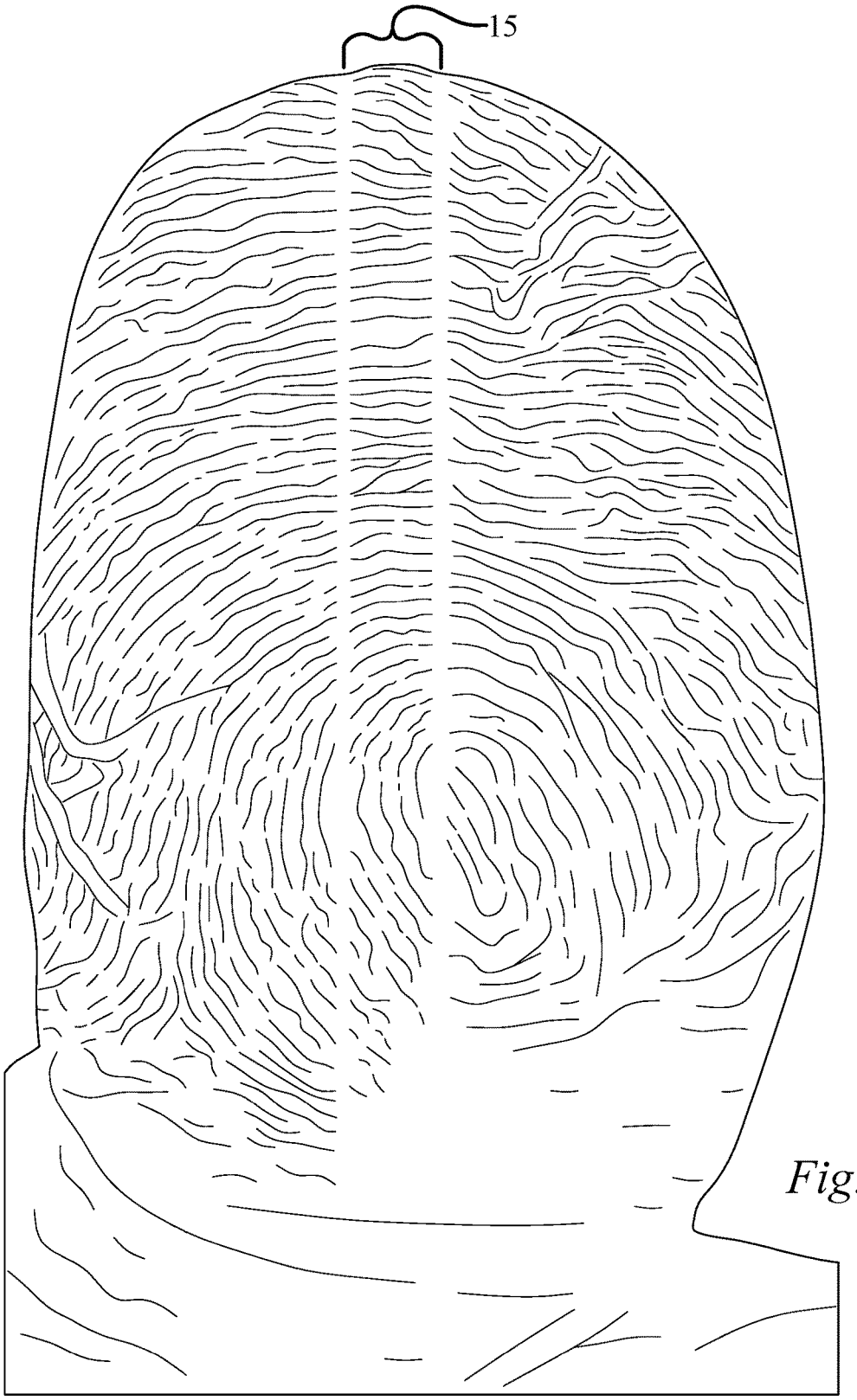
FIG. 10 is an elevation view of a user's thumb showing a dermal imprint, not to scale.

The sports equipment handle (100), contact interface, and/or the tactile reference attachment (700), on a piece of sports equipment may be custom tailored to the end users specifications such that the tactile reference indentation (200*a*) or the tactile reference projection (300*a*) coincides with a pre-selected, user preferred, hand and finger placement on the sports equipment handle (100); in fact, this is one of the key benefits of the tactile reference attachment (700) embodiments as will be explained in greater detail later, As such, the tactile reference indentation (200*a*) or the tactile reference projection (300*a*) additionally performs a "reminder" function. For example, the user will be able to feel the tactile reference indentation (200*a*) or the tactile reference projection (300*a*) and know whether they are grasping the sports equipment handle (100) with their preferred hand and finger placement, or properly engaging the contact interface. By knowing that the tactile reference indentation (200*a*) or the tactile reference projection (300*a*) coincides with the preferred placement of a body part such as the hand and finger placement and being able to tactilely perceive tactile reference indentation (200*a*) or the tactile reference projection (300*a*), the user will have a higher level of psychomotor confidence, which results in hitting, throwing, or shooting a projectile with better accuracy, and/or positioning a body part more accurately. In fact, when the user grasps the sports equipment handle (100), and/or the surface of the tactile reference attachment (700), the skin of their fingers, thumb, and/or palm will minimally sink into the tactile reference indentation (200*a*). As seen in FIG. 10, a dermal imprint (15) is formed when grasping the sports equipment handle (100) and/or the surface of the tactile reference attachment (700). The dermal imprint (15) provides a very subtle and precise psychomotor alignment "read" for the user at the microdermal neurosensory level, which ultimately leads to better movement, positioning, or aim, of the sports equipment.

In one embodiment, the tactile reference indentation length (210*a*) is at least 50 percent of the handle length (110). Having a tactile reference indentation (200*a*) that extends along at least 50 percent of the handle length (110) accommodates the numerous styles of hand positioning and gripping used to grasp a piece of sports equipment. Such a tactile reference indentation length (210*a*) maximizes the opportunity for the user's hands and fingers to come into contact with the tactile reference indentation (200*a*) to receive maximum psychomotor tactile biofeedback.

Figure 4:
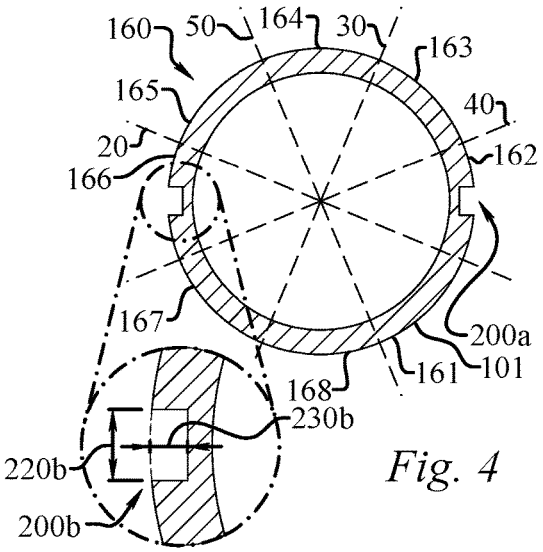
FIG. 4 is a cross-sectional view of an embodiment of a sports equipment handle, not to scale.

With reference now to FIG. 4, still another cross sectional embodiment of the sports equipment handle (100) is shown, which one skilled in the art will recognize as applying equally to the tactile reference attachment (700) embodiments seen in FIGS. 31-46. In this particular embodiment, the sports equipment handle (100) further includes a second tactile reference indentation (200*b*) extending longitudinally along the exterior body surface (160). As seen in FIG. 4, the second tactile reference indentation (200*b*) is confined to a second tactile octant selected from the group consisting of the first octant (161), the second octant (162), the third octant (163), the fourth octant (164), the fifth octant (165), the sixth octant (166), the seventh octant (167), and the eighth octant (168) that does not include the tactile reference indentation (200*a*). The second tactile reference indentation (200*b*) has a second tactile reference indentation length (210*b*), a second tactile reference indentation width (220*b*) of at least 2.0 millimeters and no greater than 5.0 millimeters, and a second tactile reference indentation depth (230*b*) of at least 0.5 millimeters. In this embodiment, there is a first tactile reference indentation (200*a*) within the first tactile octant, and a second tactile reference indentation (200*b*) within the second tactile octant. Although FIG. 4 shows the tactile reference indentation (200*a*) in the second octant (162) and second tactile reference indentation (200*b*) in the sixth octant (166), the second tactile reference indentation (200*b*) may also be located in the first octant (161), the third octant (163), the fourth octant (164), the fifth octant (165), the seventh octant (167), or the eighth octant (168) with respect to the positioning of the tactile reference indentation (200*a*) and how the octants (161, 162, 163, 164, 165, 166, 167, 168) are defined in FIG. 4. Generally, the second tactile reference indentation (200*b*) should be spaced from the tactile reference indentation (200*a*) by at least a 10 degree angle, as measured from the point of intersection between the four imaginary vertical planes (20, 30, 40, 50), which point of intersection would typically be the geometric center of the proximal end (120), i.e., the butt end, of the sports equipment handle (100) from a top plan view. Such spacing ensures that first and second tactile reference indentations (200*a*, 200*b*) are not so close together that a user would not be able to discern by tactile perception the two distinct tactile reference indentations (200*a*, 200*b*).

By providing a second tactile reference indentation (200*b*), there is an increased opportunity for the user's hand(s), and associated finger pads, thumb, and/or palm, to come into contact with the tactile reference indentations (200*a*, 200*b*) in order to receive additional tactile biofeedback. As a result, the second tactile reference indentation (200*b*) provides even more information that is available for processing by the user's natural attributes of sensibility, proprioception, and neuromuscular memory to enable the user to consistently hit, throw, or shoot a projectile with accuracy.

The sports equipment handle (100), contact interface, and/or the tactile reference attachment (700), on a piece of sports equipment may be custom tailored to the end users specifications such that the tactile reference indentation (200*a*) and the second tactile reference indentation (200*b*) coincide with a pre-selected, user preferred, body part, such as hand and finger placement, on the sports equipment handle (100) or in a piece of sports equipment; in fact, this is one of the key benefits of the tactile reference attachment (700) embodiments as will be explained in greater detail later. As such, the first and second tactile reference indentations (200*a*, 200*b*) additionally perform a "reminder" function. For example, the user will be able to feel the first and/or second tactile reference indentations (200*a*, 200*b*) and know whether they are grasping the sports equipment handle (100) with their preferred hand and finger placement. By knowing that the first and/or second tactile reference indentations (200*a*, 200*b*) coincide with the preferred hand and finger placement and being able to tactilely perceive the first and second tactile reference indentation (200*a*, 200*b*), the user will have a higher level of psychomotor confidence, which results in a better sports equipment control.

Figure 5:
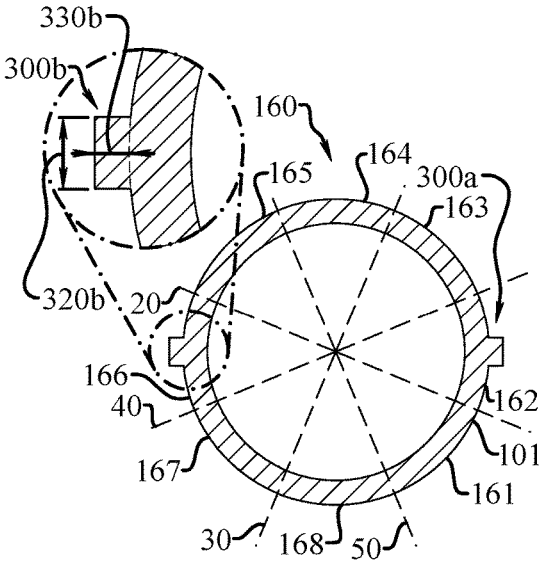
FIG. 5 is a cross-sectional view of an embodiment of the sports equipment handle, not to scale.
Figure 6:
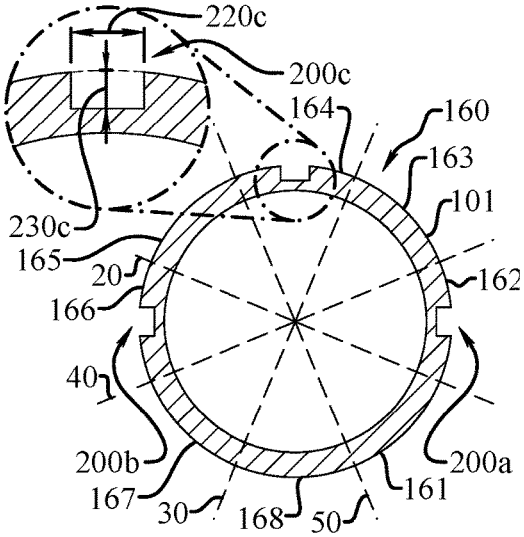
FIG. 6 is a cross-sectional view of an embodiment of the sports equipment handle, not to scale.
Figure 7:
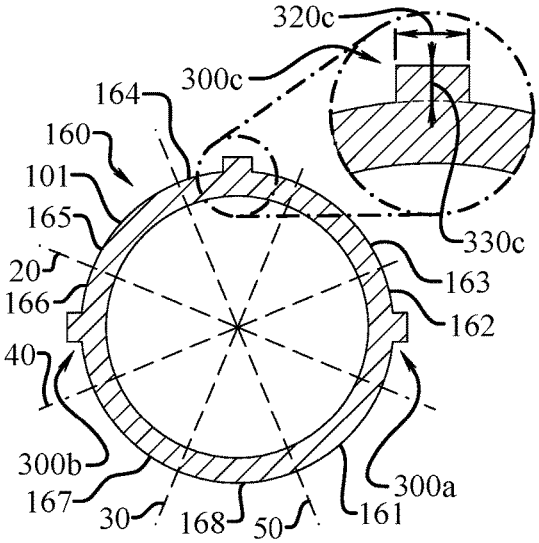
FIG. 7 is a cross-sectional view of an embodiment of a sports equipment handle, not to scale.
Figure 8:
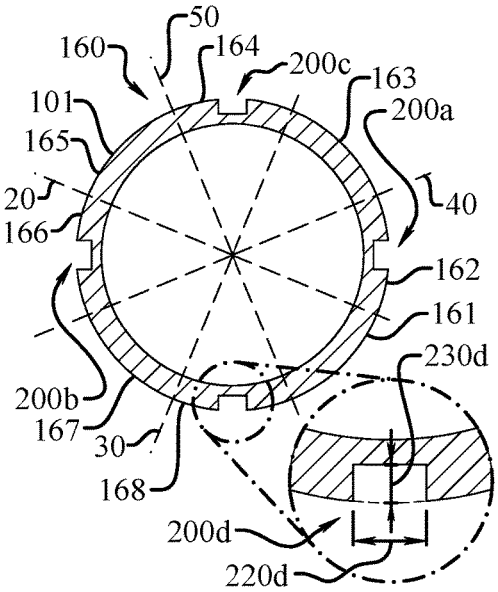
FIG. 8 is a cross-sectional view of an embodiment of a sports equipment handle, not to scale.

FIGS. 6 and 8 are cross-sectional views illustrating embodiments having multiple tactile reference indentations including at least two tactile reference indentations in non-adjacent octants and at least two non-adjacent octants having no palpable indicia. One skilled in the art will appreciate that all of this disclosure applies equally to the tactile reference attachment (700) embodiments, seen in FIGS. 31-46, where the user may attach one, or more, of the tactile reference attachment (700) to achieve the disclosed relationships, and those seen in FIGS. 2-9, as well as a contact interface which may be on the interior of a piece of sports equipment It should be noted that the embodiments shown in FIGS. 6 and 8 do not reflect all the possible combinations of arrangements at least two tactile reference indentations in non-adjacent octants and at least two non-adjacent octants having no palpable indicia but rather merely a few illustrative embodiments. Again, these embodiments ensure sufficient spacing of the tactile reference indentations (200*a*, 200*b*) to avoid providing competing tactile information that could be misinterpreted by the user's natural body processes of sensibility, proprioception, and neuromuscular memory.

With reference now to FIG. 5, still another cross sectional embodiment of the sports equipment handle (100) is shown. In this particular embodiment, the sports equipment handle (100) further includes a second tactile reference projection (300*b*) extending longitudinally along the exterior body surface (160). As seen in FIG. 5, the second tactile reference projection (300*b*) is confined to a second tactile octant selected from the group consisting of the first octant (161), the second octant (162), the third octant (163), the fourth octant (164), the fifth octant (165), the sixth octant (166), the seventh octant (167), and the eighth octant (168) that does not include the tactile reference projection (300*a*). The second tactile reference projection (300*b*) has a second tactile reference indentation length (310*b*), a second tactile reference projection width (320*b*) of at least 2.0 millimeters and no greater than 5.0 millimeters, and a tactile reference projection depth (330*b*) of at least 0.5 millimeters. In this embodiment, there is a first tactile reference projection (300*a*) within the first tactile octant, and a second tactile reference projection (300*b*) within the second tactile octant. Although FIG. 5 shows the tactile reference projection (300*a*) in the second octant (162) and second tactile reference projection (300*b*) in the sixth octant (166), the second tactile reference projection (300*b*) may also be located in the first octant (161), the third octant (163), the fourth octant (164), the fifth octant (165), the seventh octant (167), or the eighth octant (168) with respect to the positioning of the tactile reference indentation (200*a*) and how the octants (161, 162, 163, 164, 165, 166, 167, 168) are defined in FIG. 5. Generally, the second tactile reference projection (300*b*) should be spaced from the tactile reference projection (300*a*) by at least a 10 degree angle, as measured from the point of intersection between the four imaginary vertical planes (20, 30, 40, 50), which point of intersection would typically be the geometric center of the proximal end (120), i.e., the butt end, of the sports equipment handle (100) from a top plan view. Such spacing ensures that first and second tactile reference projection (300*a*, 300*b*) are not so close together that a user would not be able to discern by tactile perception the two distinct tactile reference projection (300*a*, 300*b*).

By providing a second tactile reference projection (300*b*), there is an increased opportunity for both of the user's hands, and associated finger pads, thumb, and/or palm, to come into contact with the tactile reference projections (300*a*, 300*b*) in order to receive additional tactile biofeedback. As a result, the second tactile reference projection (300*b*) provides even more information that is available for processing by the user's natural attributes of sensibility, proprioception, and neuromuscular memory to enable the user to consistently hit, throw, or shoot a projectile with accuracy.

Figure 9:
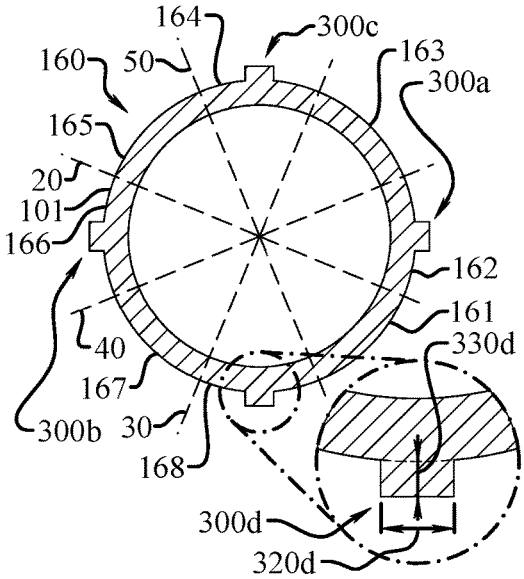
FIG. 9 is a cross-sectional view of an embodiment of the sports equipment handle, not to scale.

FIGS. 7 and 9 shows are cross-sectional views illustrating embodiments having multiple tactile reference indentations including at least two tactile reference projections in non-adjacent octants and at least two non-adjacent octants having no palpable indicia. One skilled in the art will appreciate that all of this disclosure applies equally to the tactile reference attachment (700) embodiments, seen in FIGS. 31-46, where the user may attach one, or more, of the tactile reference attachment (700) to achieve the disclosed relationships, and those seen in FIGS. 2-9. It should be noted that the embodiments shown in FIGS. 7 and 9 do not reflect all the possible combinations of arrangements at least two tactile reference projections in non-adjacent octants and at least two non-adjacent octants having no palpable indicia but rather two illustrative embodiments. Again, these embodiments ensure sufficient spacing of the tactile reference projections (300*a*, 300*b*) to avoid providing competing tactile information that could be misinterpreted by the user's natural body processes of sensibility, proprioception, and neuromuscular memory.

The sports equipment handle (100), contact interface, and/or the tactile reference attachment (700), on a piece of sports equipment may be custom tailored to the end users specifications such that the tactile reference projection (300*a*) and the second tactile reference projection (300*b*) coincide with a pre-selected, user preferred, hand and finger placement on the sports equipment handle (100); in fact, this is one of the key benefits of the tactile reference attachment (700) embodiments as will be explained in greater detail later. As such, the first and/or second tactile reference projections (300*a*, 300*b*) additionally perform a "reminder" function. For example, the user will be able to feel the first and/or second tactile reference projections (300*a*, 300*b*) and know whether they are grasping the sports equipment handle (100) with their preferred hand and finger placement. By knowing that the first and/or second tactile reference projections (300*a*, 300*b*) coincide with the preferred hand and finger placement and being able to tactilely perceive the first and/or second tactile reference projections (300*a*, 300*b*), the user will have a higher level of psychomotor confidence, which results in a better sports equipment control.

Figure 11:
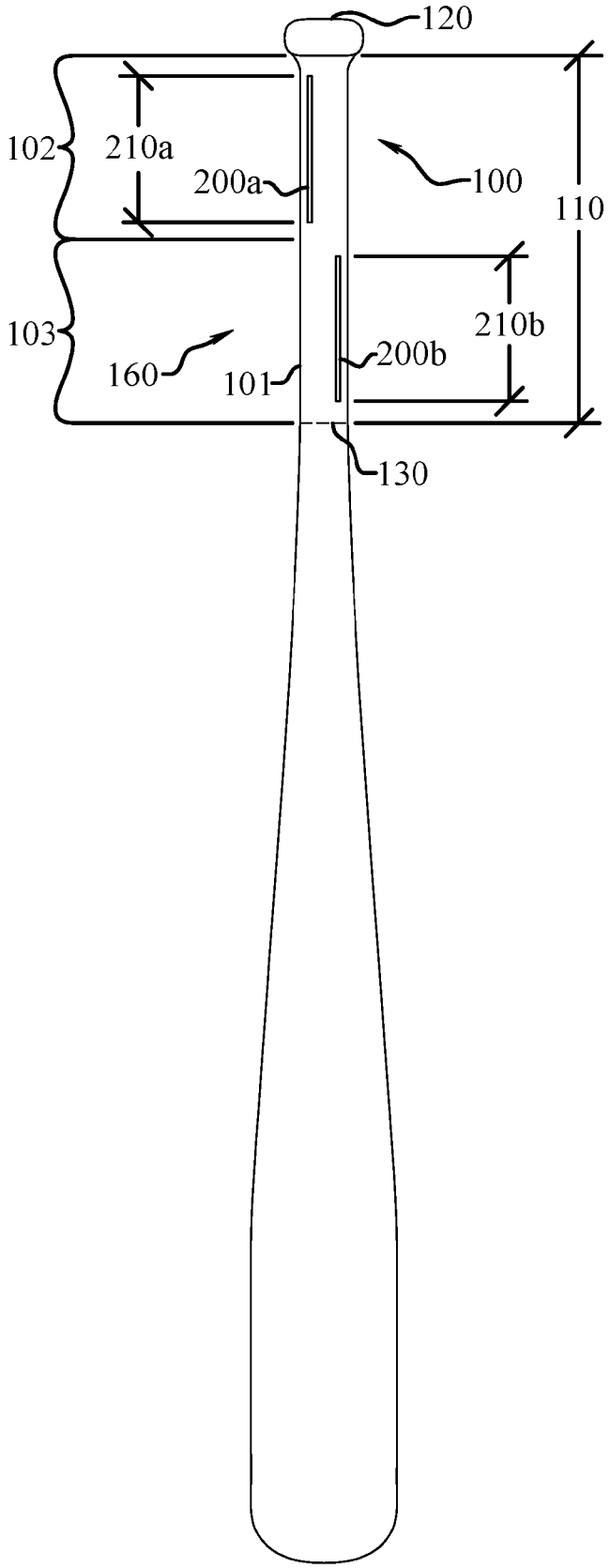
FIG. 11 is a front elevation view of an embodiment of a sports equipment handle on a baseball bat, not to scale.

Referring now to FIG. 11, an additional embodiment of the sports equipment handle (100) having a tactile reference indentation (200*a*) and a second tactile reference indentation (200*b*) is shown. In this particular embodiment, the tactile reference indentation (200*a*) is confined to the upper portion (102) of the sports equipment handle (100) and the second tactile reference indentation (200*b*) is confined to the lower portion (103) of the sports equipment handle (100). Similarly, such a configuration may be implemented via the tactile reference attachment (700) embodiment seen in FIG. 38 where it is a sleeve that is rolled onto, or attached around, a handle, which includes some embodiments in which such sleeves are shrink-wrapped around a portion of a handle. For instance, in one embodiment, a heat activated shrink-wrapped sleeve may be made of, but is not limited to, PETG, PVC, OPS, PE, or PLA shrink films. Although not specifically shown in FIG. 11, it should be noted that the tactile reference indentation (200*a*) and the second tactile reference indentation (200*b*) are confined to separate octants. This particular embodiment strategically positions the tactile reference indentation (200*a*) and the second tactile reference indentation (200*b*) so that the left thumb of a right-handed user contacts the tactile reference indentation (200*a*) and the user's right thumb contacts the second tactile reference indentation (200*b*). Thus, the user will be able to sense the first and/or second tactile reference indentations (200*a*, 200*b*), which harnesses their natural attributes of sensibility, proprioception, and neuromuscular memory to enable the user to consistently hit, grasp, throw, or shoot a projectile with accuracy. Of course, an embodiment suited for a left-handed person using a conventional handle is also contemplated. In the left-handed version of the sports equipment handle (100), the tactile reference indentation (200*a*) would be confined to the lower portion (103) and the second tactile reference indentation (200*b*) would be confined to the upper portion (102) such that that the left thumb of a left-handed user contacts the tactile reference indentation (200*a*) and/or the user's right thumb contacts the second tactile reference indentation (200*b*).

In another embodiment of the sports equipment handle (100) having a tactile reference projection (300*a*) and a second tactile reference projection (300*b*), the tactile reference projection (300*a*) is confined to the upper portion (102) of the sports equipment handle (100) and the second tactile reference projection (300*b*) is confined to the lower portion (103) of the sports equipment handle (100). In this embodiment, the tactile reference projection (300*a*) and the second tactile reference projection (300*b*) are confined to separate octants. This particular embodiment strategically positions the tactile reference projection (300*a*) and/or the second tactile reference projection (300*b*) so that the left thumb of a right-handed user contacts the tactile reference projection (300*a*) and/or the user's right thumb contacts the second tactile reference projection (300*b*). Thus, the user will be able to sense the first and/or second tactile reference projections (300*a*, 300*b*), which harnesses their natural attributes of sensibility, proprioception, and neuromuscular memory to enable the user to consistently hit, throw, or shoot a projectile with accuracy. Of course, an embodiment suited for a left-handed person using a conventional handle is also contemplated. In the left-handed version of the sports equipment handle (100), the tactile reference projection (300*a*) would be confined to the lower portion (103) and the second tactile reference projection (300*b*) would be confined to the upper portion (102) such that that the left thumb of a left-handed user contacts the tactile reference projection (300*a*) and/or the user's right thumb contacts the second tactile reference projection (300*b*).

Figure 12:
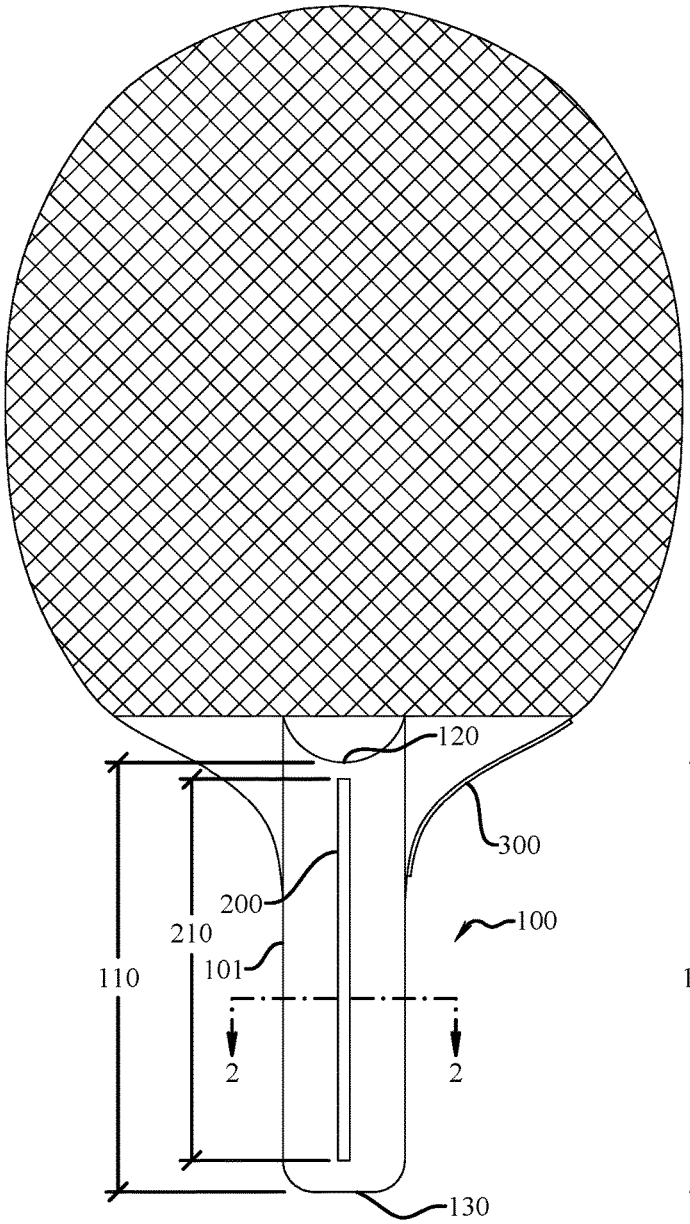
FIG. 12 is a front elevation view of an embodiment of a sports equipment handle on a ping-pong paddle, not to scale.
Figure 32:
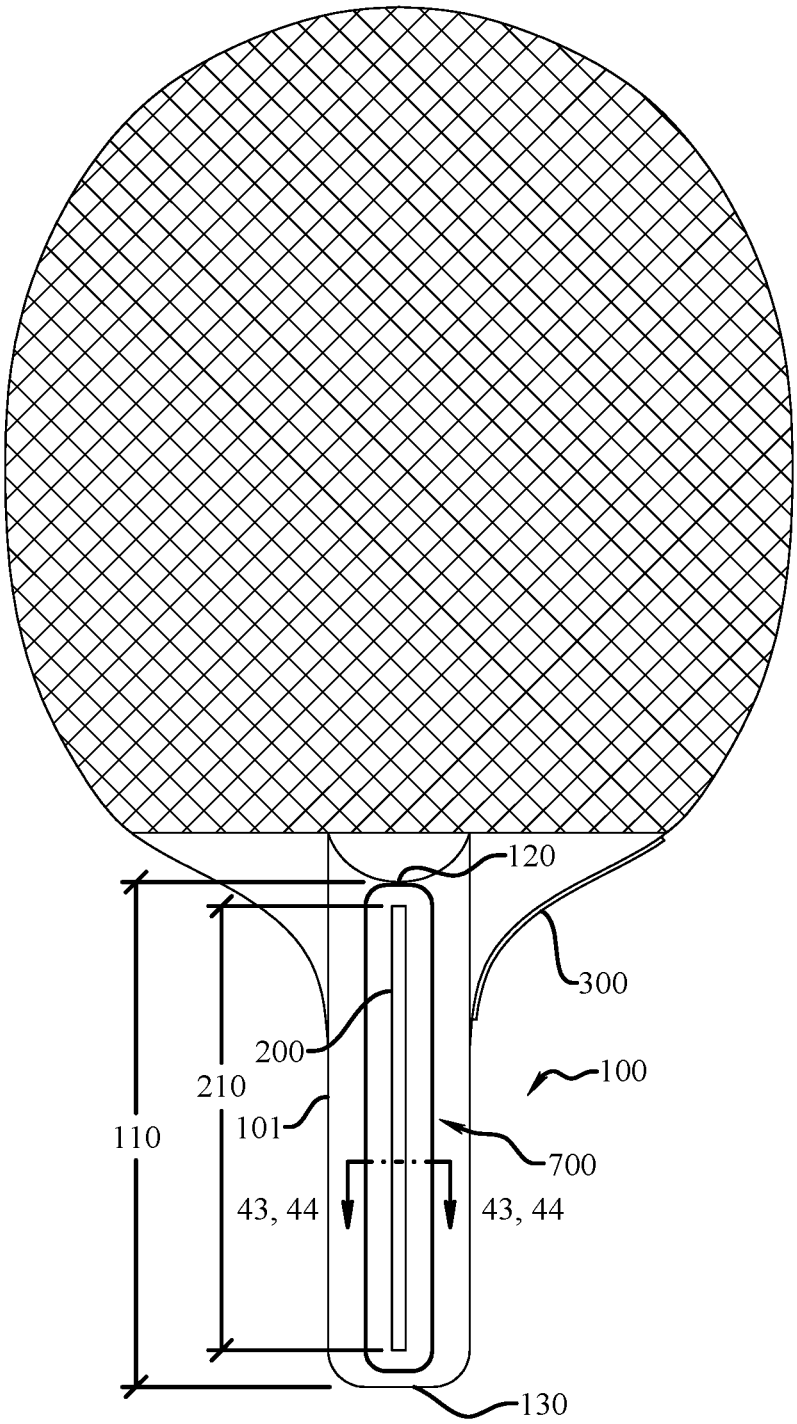
FIG. 32 is a front elevation view of an embodiment of a sports equipment handle on a ping-pong paddle, not to scale.

Referring now to FIGS. 12 and 32, embodiments of a sports equipment handle (100) and a tactile reference attachment (700) on a ping pong paddle are illustrated. As seen in FIG. 12, the sports equipment handle (100) includes a handle body (101) having a handle length (110), a proximal end (120), a distal end (130), and an exterior body surface (160). FIG. 12 includes a reference to section line 2-2 and the associated cross-section illustrated in FIG. 2. While the cross-sectional shape of FIG. 2 is circular, one skilled in the art will appreciate that the principles described herein apply equally to non-circular configurations such as the commonly elliptical shape of a ping pong paddle handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein. Similarly, repeated reference in sections 2-2 and 3-3 in the figures is merely for simplicity to illustrate the various elements of the tactile reference indentation (200) or projection (300), and that either, or both, may be applied to the various pieces of sports equipment in any of the disclosed combinations, and the elevation views may simply refer to element numbers 200 and 300, while the sections of FIGS. 2-9 may refer to element numbers 200*a*,

*b, c*, and *d*, as well as 300*a, b, c*, and *d*, depending on the quantity of indentations or projections within the illustrated section.

Figure 13:
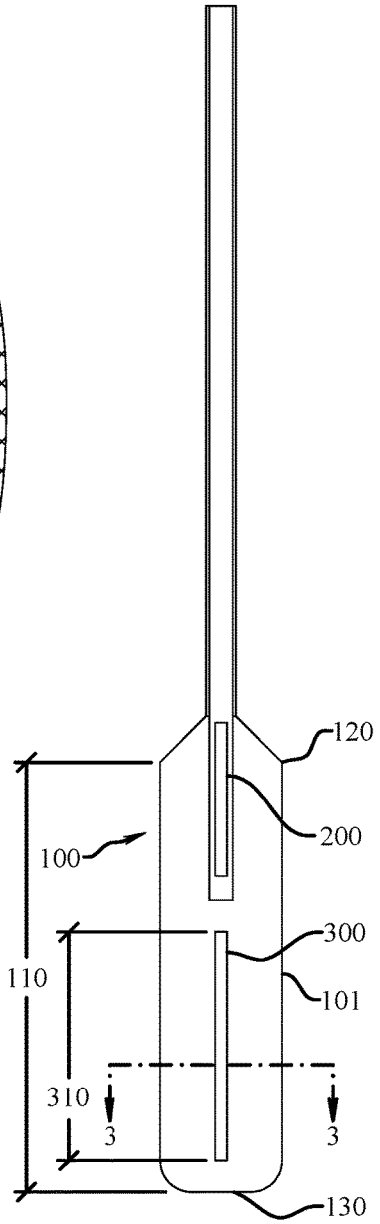
FIG. 13 is a side elevation view of an embodiment of a sports equipment handle on a ping-pong paddle, not to scale.

Referring now to FIG. 13, an embodiment of a sports equipment handle (100) on a ping pong paddle is illustrated. In this embodiment the sports equipment handle (100) includes a handle body (101) having a handle length (110), a proximal end (120), a distal end (130), and an exterior body surface (160). Just as the baseball bat embodiment may incorporate at least one tactile reference indentation (200), projection (300), or combination of the both, whether formed in the sports equipment handle (100) or attached as a tactile reference attachment (700), so to may all the embodiments disclosed herein, including the ping pong paddle embodiment currently discussed. Worth emphasizing one last time, FIG. 13 includes a reference to section line 3-3 and the associated cross-section illustrated in FIG. 3. While the cross-sectional shape of FIG. 3 is circular, one skilled in the art will appreciate that the principles described herein apply equally to non-circular configurations such as the commonly elliptical shape of a ping pong paddle handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Additionally, table tennis players use a wide variety of grip styles when holding a ping pong paddle, including the shakehand grip, the penhold grip, and the Seemiller grip. Many grip styles incorporate a portion of the user's gripping hand wrapping around the proximal end (120) of the handle (100) and a portion of the paddle surface itself. Thus, a further embodiment may incorporate a tactile reference projection (300) along an edge of the paddle surface, as seen in FIG. 12. Likewise, another embodiment may incorporate a tactile reference indentation (200) along an edge of the paddle surface, as seen in FIG. 13. In each of these embodiments the lineal length of the tactile reference projection (300) or indentation (200) is at least 0.5 inches long, but may extend several inches to accommodate a wide variety of gripping styles. In these embodiments the paddle edge tactile reference indentation (200) and/or projection (300) may be in addition to, or in lieu of, tactile reference features on the handle itself. Such paddle edge embodiments provide the user with additional biofeedback regarding the plane of the paddle surface via contact with the thumb, the index finger, and/or the area between the thumb and index finger, often referred to as the thenar space and/or webbing. The previously disclosed size of the tactile reference indentation (200) and projection (300) allow the user to spontaneously sense the orientation of the paddle surface.

Figure 14:
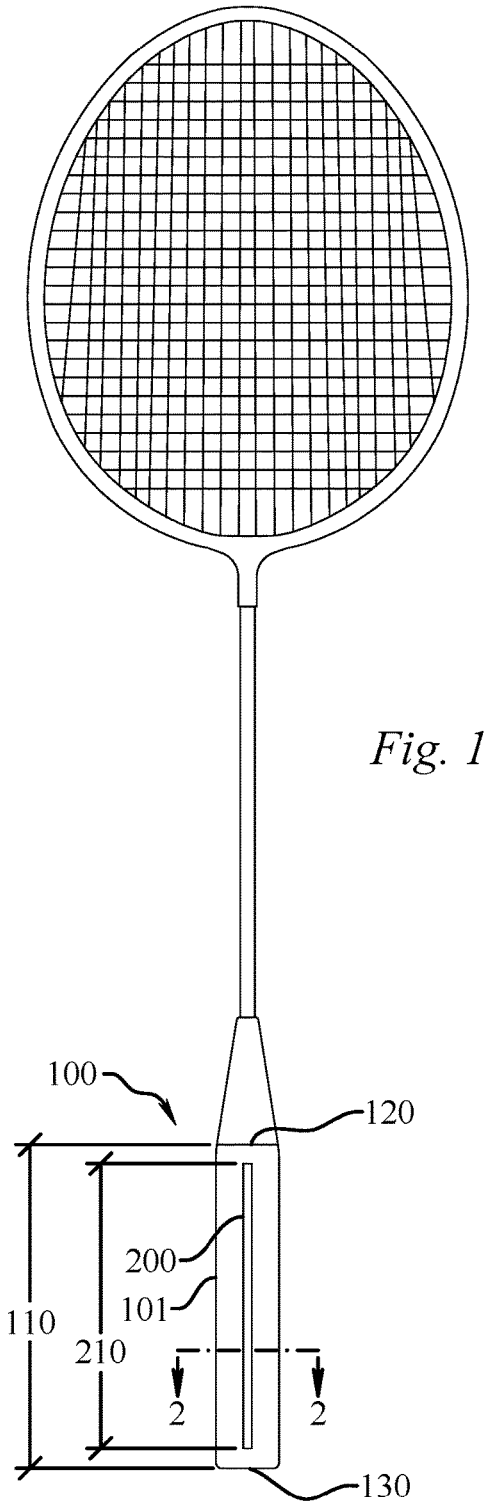
FIG. 14 is a front elevation view of an embodiment of a sports equipment handle on a badminton racquet, not to scale.
Figure 33:
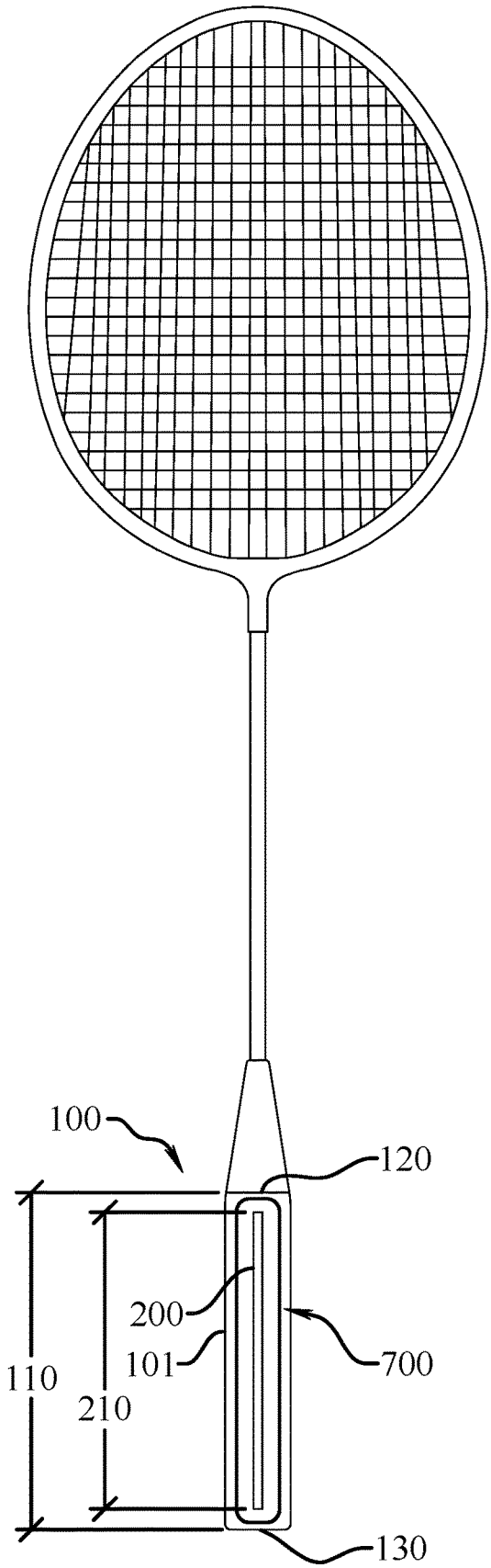
FIG. 33 is a front elevation view of an embodiment of a sports equipment handle on a badminton racquet, not to scale.

Referring now to FIGS. 14 and 33, embodiments of a sports equipment handle (100) and a tactile reference attachment (700) on a badminton racquet are illustrated. As seen in FIG. 14, the sports equipment handle (100) includes a handle body (101) having a handle length (110), a proximal end (120), a distal end (130), and an exterior body surface (160). FIG. 14 includes a reference to section line 2-2 and the associated cross-section illustrated in FIG. 2. While the cross-sectional shape of FIG. 2 is circular, one skilled in the art will appreciate that the principles described herein apply equally to non-circular configurations such as the commonly multi-sided rectangular shape of a badminton racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 15:
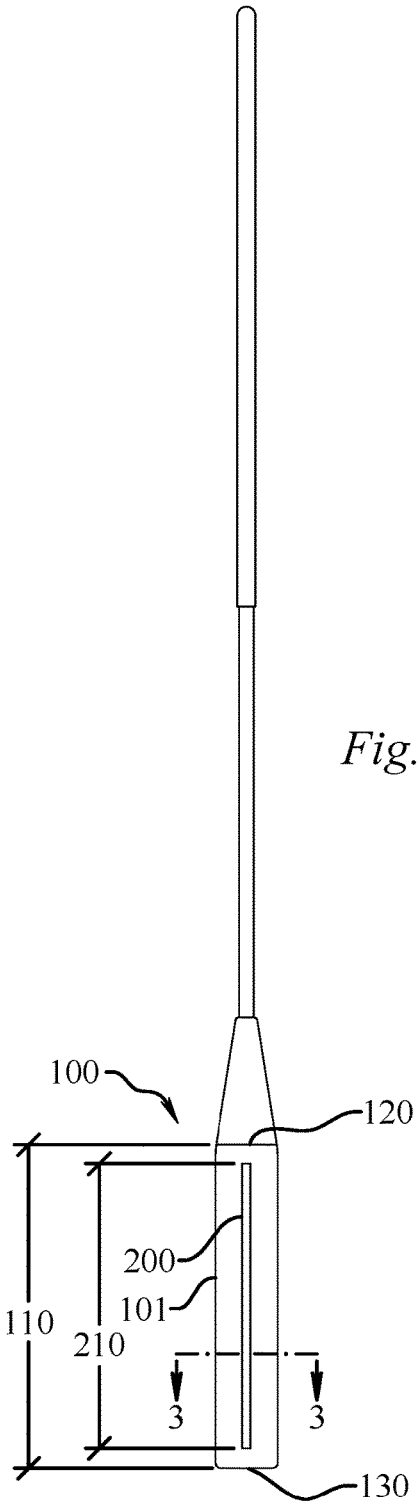
FIG. 15 is a side elevation view of an elevation view of an embodiment of a sports equipment handle on a badminton racquet, not to scale.

Referring now to FIG. 15, an embodiment of a sports equipment handle (100) on a badminton racquet is illustrated. In this embodiment the sports equipment handle (100) includes a handle body (101) having a handle length (110), a proximal end (120), a distal end (130), and an exterior body surface (160). Just as the baseball bat embodiment and ping pong paddle embodiment may incorporate at least one tactile reference indentation (200), projection (300), or combination of the both, so to may all the embodiments disclosed herein, including the badminton racquet embodiment currently discussed. Worth emphasizing one last time, FIG. 15 includes a reference to section line 3-3 and the associated cross-section illustrated in FIG. 3. While the cross-sectional shape of FIG. 3 is circular, one skilled in the art will appreciate that the principles described herein apply equally to non-circular configurations such as the commonly multi-sided rectangular shape of a badminton racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 16:
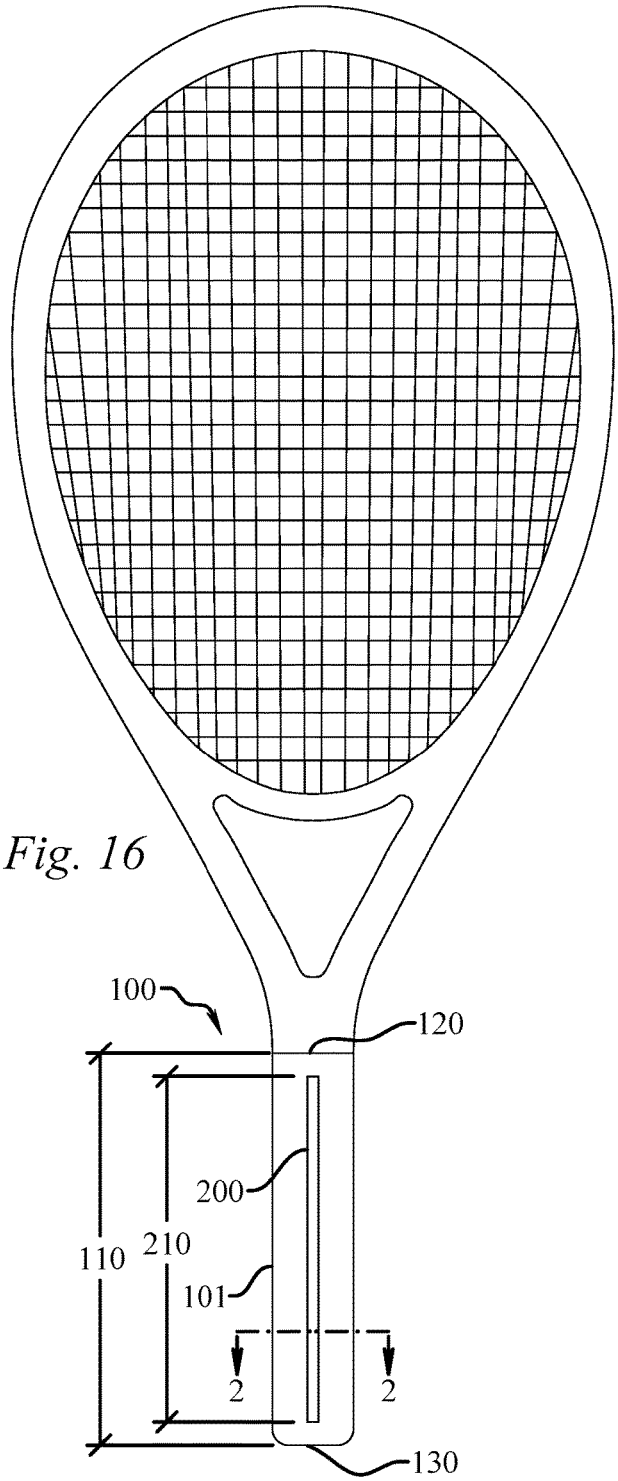
FIG. 16 is a front elevation view of an embodiment of a sports equipment handle on a tennis racquet, not to scale.
Figure 34:
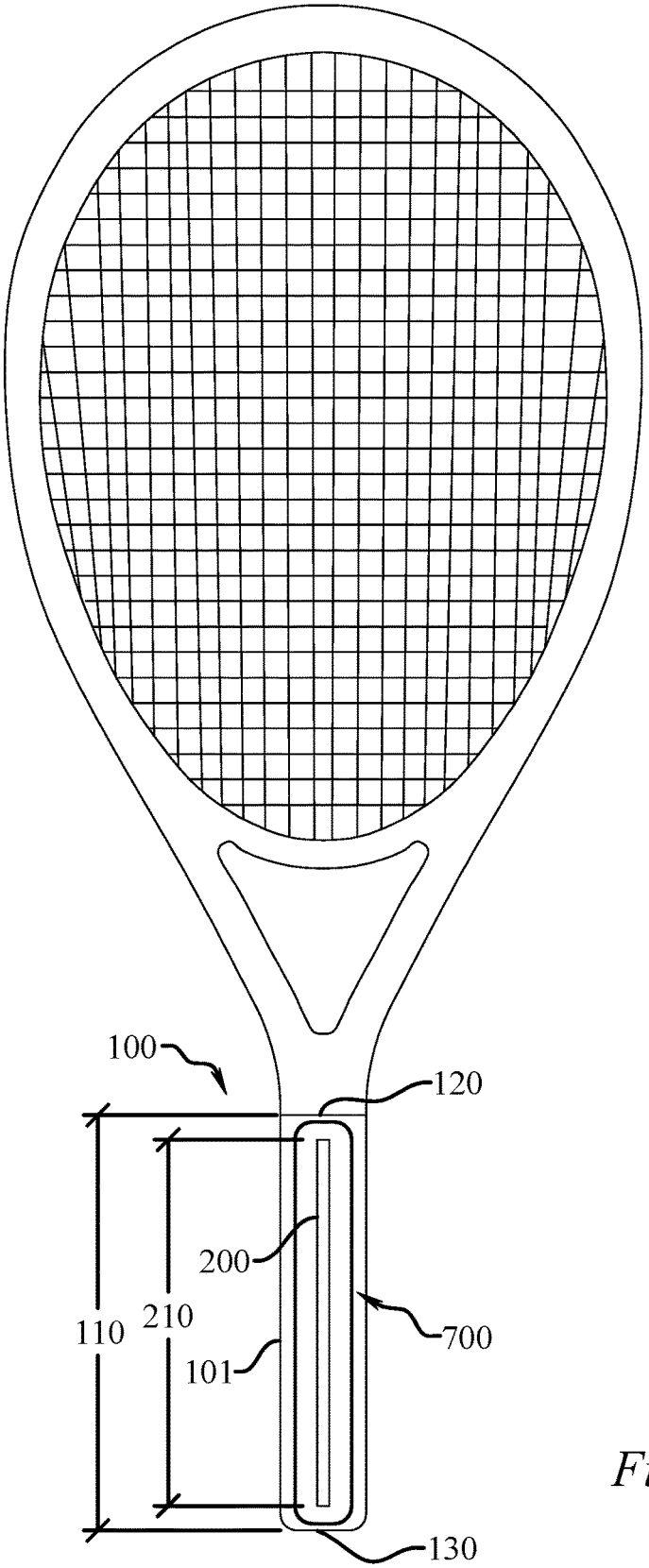
FIG. 34 is a front elevation view of an embodiment of a sports equipment handle on a tennis racquet, not to scale.

Referring now to FIGS. 16 and 34, embodiments of a sports equipment handle (100) and a tactile reference attachment (700) on a tennis racquet are illustrated. As seen in FIG. 16, the sports equipment handle (100) includes a handle body (101) having a handle length (110), a proximal end (120), a distal end (130), and an exterior body surface (160). FIG. 16 includes a reference to section line 2-2 and the associated cross-section illustrated in FIG. 2. While the cross-sectional shape of FIG. 2 is circular, one skilled in the art will appreciate that the principles described herein apply equally to non-circular configurations such as the commonly multi-sided rectangular shape of a tennis racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 17:
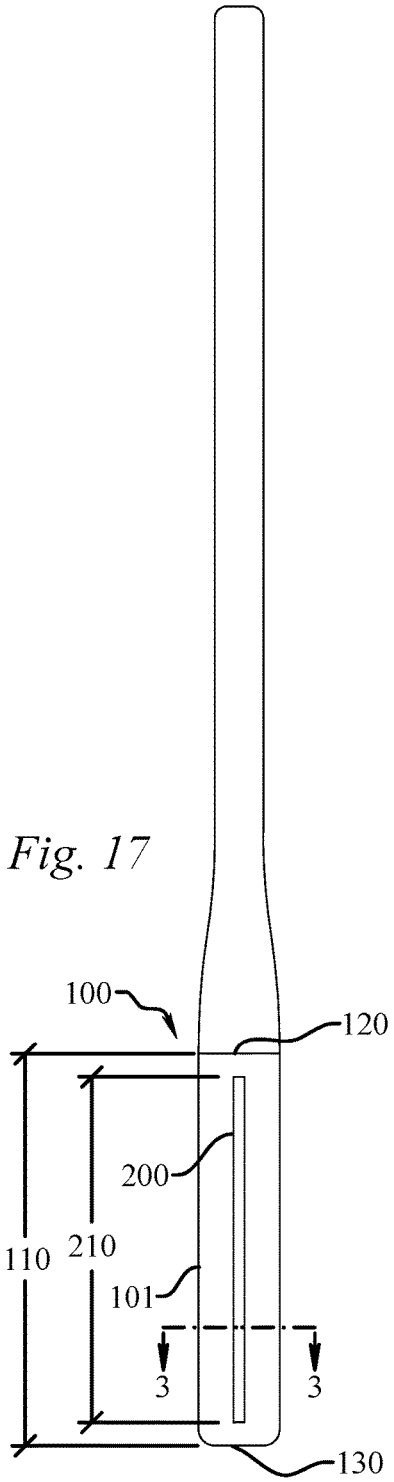
FIG. 17 is a side elevation view of an embodiment of a sports equipment handle on a tennis racquet, not to scale.

Referring now to FIG. 17, an embodiment of a sports equipment handle (100) on a tennis racquet is illustrated. In this embodiment the sports equipment handle (100) includes a handle body (101) having a handle length (110), a proximal end (120), a distal end (130), and an exterior body surface (160). Just as the baseball bat embodiment, ping pong paddle embodiment, and badminton racquet embodiment may incorporate at least one tactile reference indentation (200), projection (300), or combination of the both, so to may all the embodiments disclosed herein, including the tennis racquet embodiment currently discussed. Worth emphasizing again, FIG. 17 includes a reference to section line 3-3 and the associated cross-section illustrated in FIG. 3. While the cross-sectional shape of FIG. 3 is circular, one skilled in the art will appreciate that the principles described herein apply equally to non-circular configurations such as the commonly multi-sided rectangular shape of a tennis racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 18:
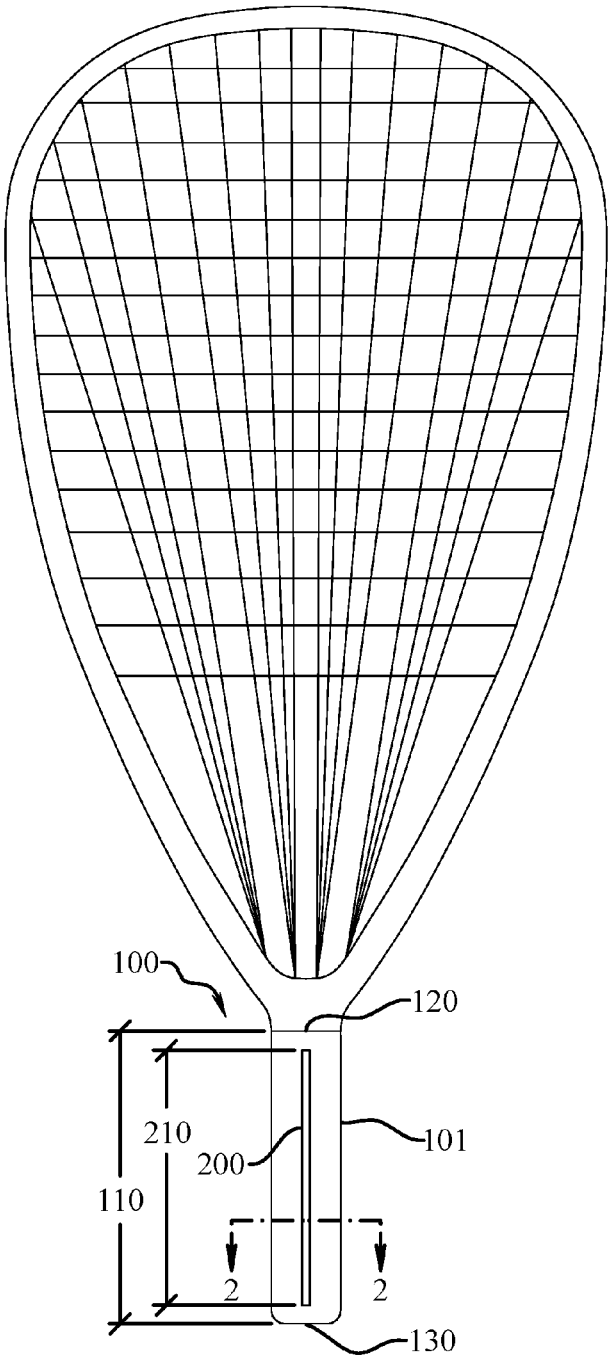
FIG. 18 is a front elevation view of an embodiment of a sports equipment handle on a racquet ball racquet, not to scale.
Figure 35:
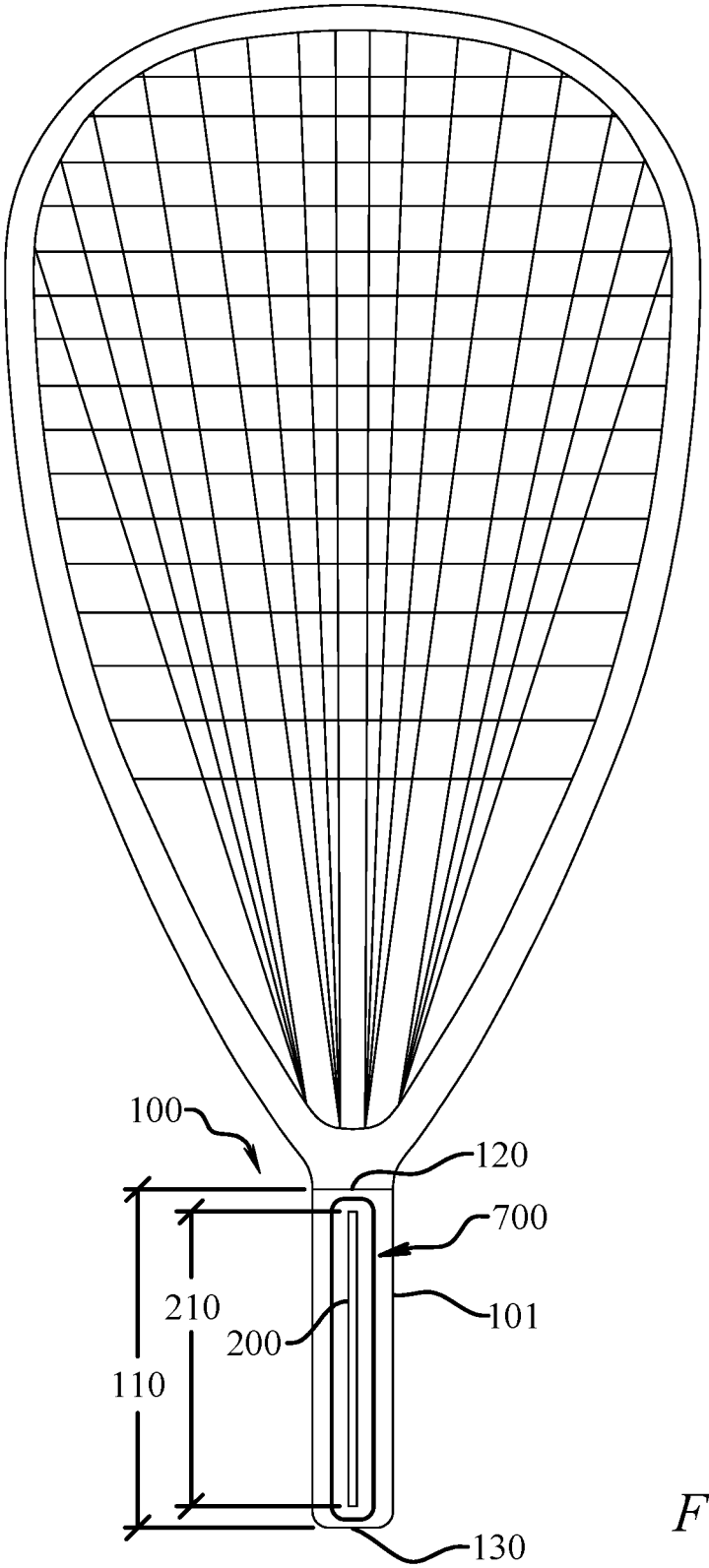
FIG. 35 is a front elevation view of an embodiment of a sports equipment handle on a racquet ball racquet, not to scale.

Referring now to FIGS. 18 and 35, embodiments of a sports equipment handle (100) and a tactile reference attachment (700) on a racquetball racquet, or squash racquet, are illustrated. As seen in FIG. 18, the sports equipment handle (100) includes a handle body (101) having a handle length (110), a proximal end (120), a distal end (130), and an exterior body surface (160). FIG. 18 includes a reference to section line 2-2 and the associated cross-section illustrated in FIG. 2. While the cross-sectional shape of FIG. 2 is circular, one skilled in the art will appreciate that the principles described herein apply equally to non-circular configurations such as the commonly multi-sided rectangular shape of a racquetball racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 19:
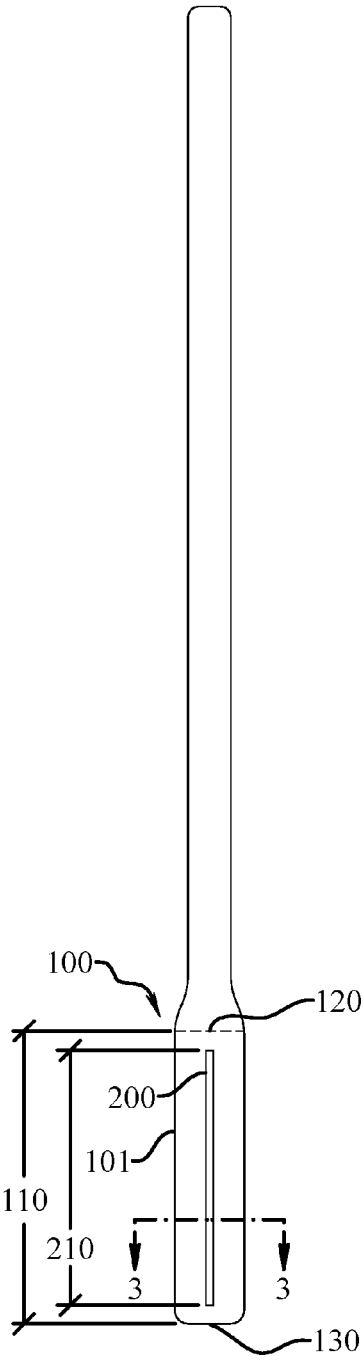
FIG. 19 is a side elevation view of an embodiment of a sports equipment handle on a racquet ball racquet, not to scale.

Referring now to FIG. 19, an embodiment of a sports equipment handle (100) on a racquetball racquet is illustrated. In this embodiment the sports equipment handle (100) includes a handle body (101) having a handle length (110), a proximal end (120), a distal end (130), and an exterior body surface (160). Just as the baseball bat embodiment, ping pong paddle embodiment, badminton racquet embodiment, and tennis racquet embodiment may incorporate at least one tactile reference indentation (200), projection (300), or combination of the both, so to may all the embodiments disclosed herein, including the racquetball racquet embodiment currently discussed. Worth emphasizing again, FIG. 19 includes a reference to section line 3-3 and the associated cross-section illustrated in FIG. 3. While the cross-sectional shape of FIG. 3 is circular, one skilled in the art will appreciate that the principles described herein apply equally to non-circular configurations such as the commonly multi-sided rectangular shape of a racquetball racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 20:
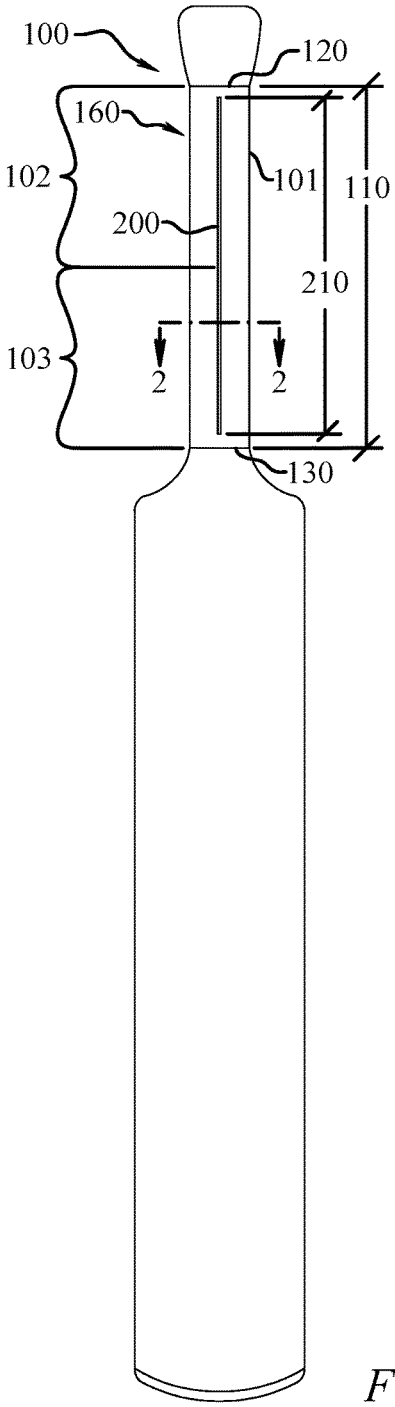
FIG. 20 is a front elevation view of an embodiment of a sports equipment handle on a cricket bat, not to scale.
Figure 36:
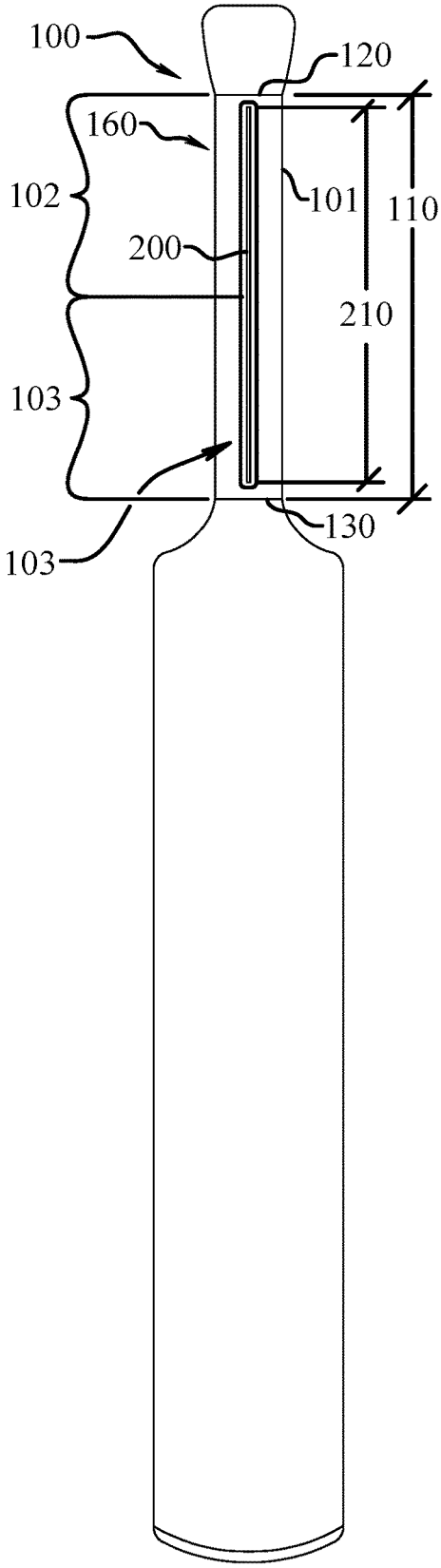
FIG. 36 is a front elevation view of an embodiment of a sports equipment handle on a cricket bat, not to scale.

Referring now to FIGS. 20 and 36, embodiments of a sports equipment handle (100) and a tactile reference attachment (700) on a cricket bat are illustrated. As seen in FIG. 20, the sports equipment handle (100) includes a handle body (101) having a handle length (110), a proximal end (120), a distal end (130), and an exterior body surface (160). FIG. 20 includes a reference to section line 2-2 and the associated cross-section illustrated in FIG. 2. While the cross-sectional shape of FIG. 2 is circular, one skilled in the art will appreciate that the principles described herein apply equally to non-circular configurations such as the commonly elliptical shape of a cricket bat handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 21:
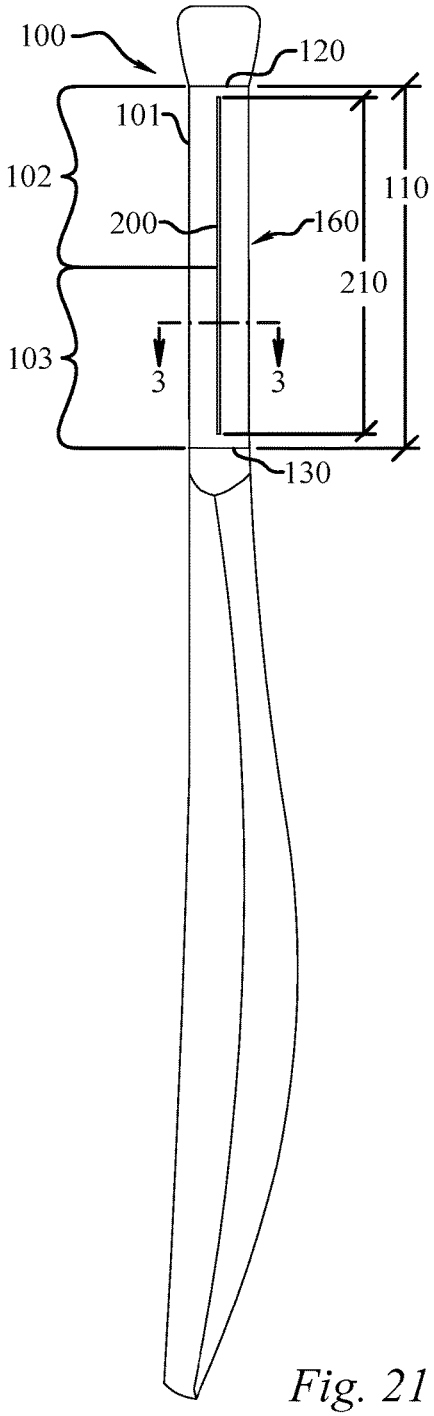
FIG. 21 is a side elevation view of an embodiment of a sports equipment handle on a cricket bat, not to scale.

Referring now to FIG. 21, an embodiment of a sports equipment handle (100) on a cricket bat is illustrated. In this embodiment the sports equipment handle (100) includes a handle body (101) having a handle length (110), a proximal end (120), a distal end (130), and an exterior body surface (160). Just as the baseball bat embodiment, ping pong paddle embodiment, badminton racquet embodiment, tennis racquet embodiment, and racquetball racquet embodiments may incorporate at least one tactile reference indentation (200), projection (300), or combination of the both, so to may all the embodiments disclosed herein, including the cricket bat embodiment currently discussed. Worth emphasizing again, FIG. 21 includes a reference to section line 3-3 and the associated cross-section illustrated in FIG. 3. While the cross-sectional shape of FIG. 3 is circular, one skilled in the art will appreciate that the principles described herein apply equally to non-circular configurations such as the commonly multi-sided elliptical shape of a cricket bat handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

In each of the embodiments described above the tactile reference indentation length (210) and the tactile reference projection length (310) is at least 25 millimeters to ensure a substantial portion of at least one hand is in contact with the indentation or projection while gripping the handle (100). In one particular preferred embodiment the tactile reference indentation length (210) and the tactile reference projection length (310) is at least six inches to ensure a substantial portion of at least one hand is in contact with the indentation or projection while gripping the handle (100) while allowing a degree of flexibility in the actual location that a user places their hand(s) on the handle (100).

Figure 22:
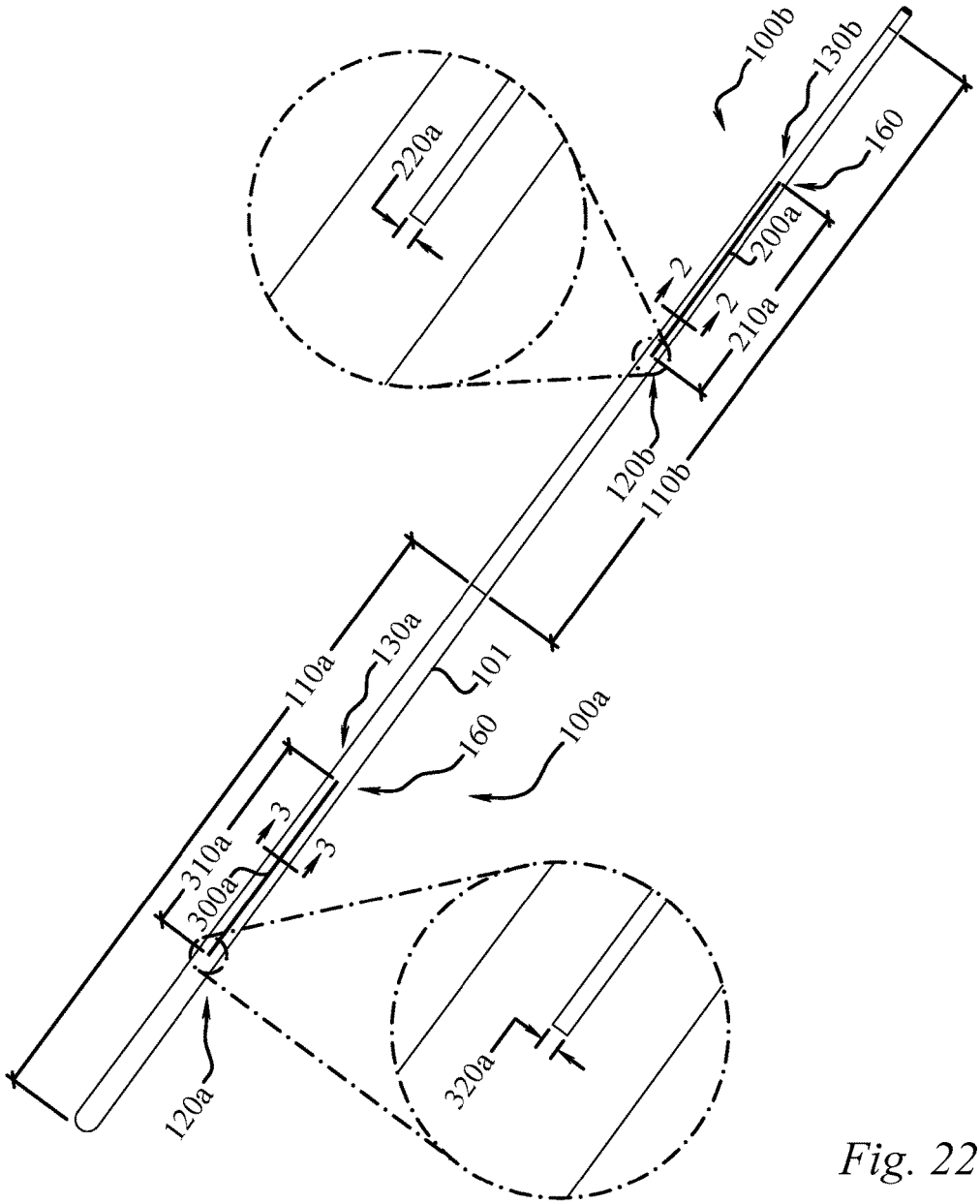
FIG. 22 is a front elevation view of an embodiment of a sports equipment handle on a pool cue, not to scale.
Figure 37:
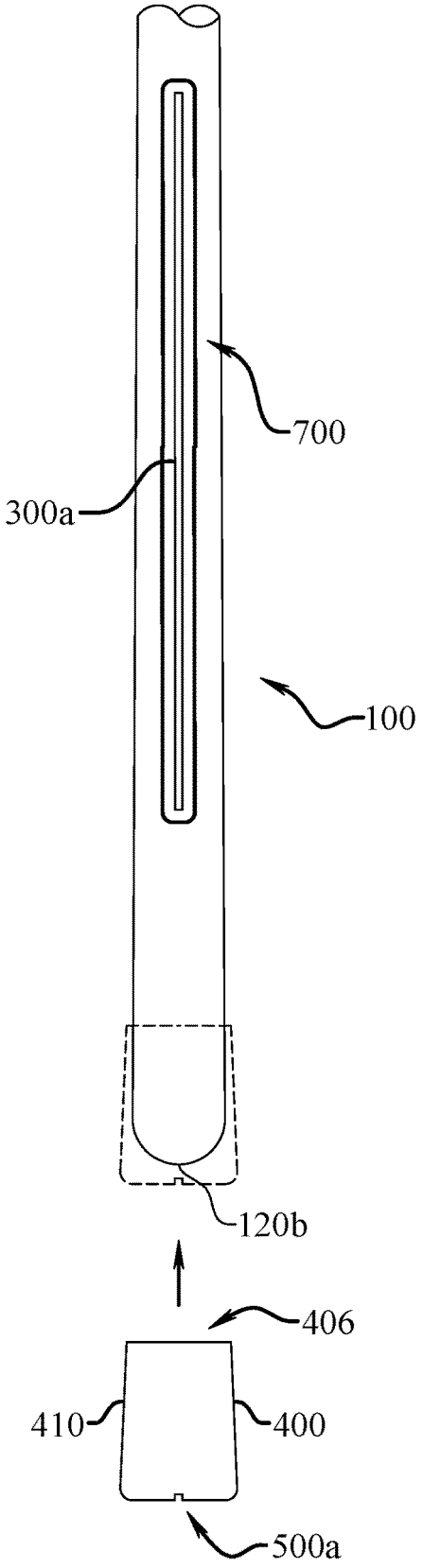
FIG. 37 is a front elevation view of a pool cue end cap and pool cue, not to scale.
Figure 38:
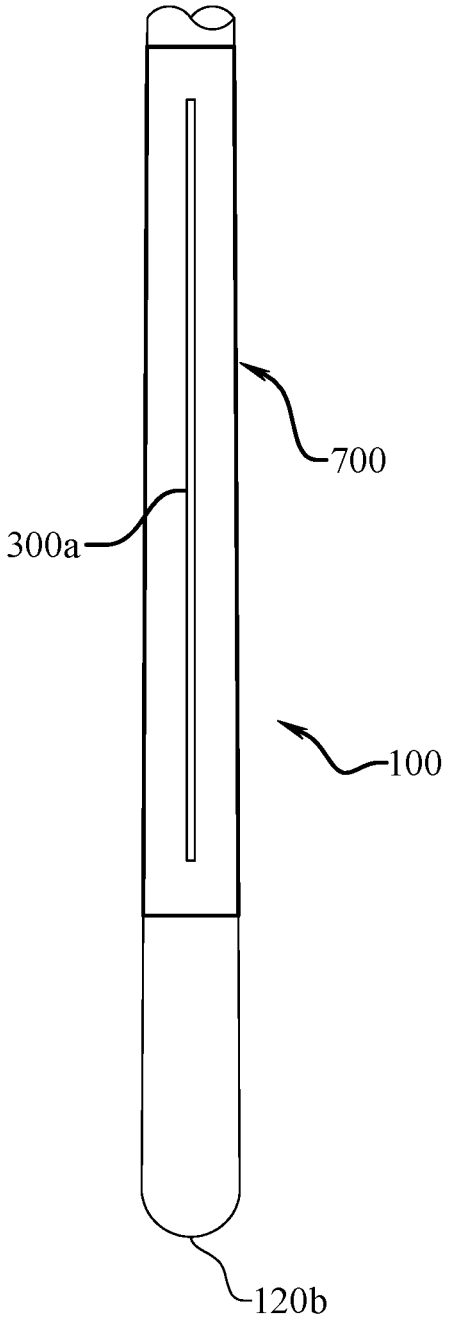
FIG. 38 is a front elevation view of a pool cue end cap and pool cue, not to scale.

Referring now to FIGS. 22 and 37, embodiments of a sports equipment handle (100*a*) and a tactile reference attachment (700) on a pool cue are illustrated. A pool cue is generally contacted by both hands of a user and therefore includes two handle sections, namely a top section (100*a*) and a bottom section (100*b*). The top section (100*a*) has a top section handle length (110*a*), a top section proximal end (120*a*), and a top section distal end (130*a*). The bottom section (100*b*) has a bottom section handle length (110*b*), a bottom section proximal end (120*b*), and a bottom section distal end (130*b*). As with all prior embodiments, the pool cue embodiment has an exterior body surface (160).

The embodiment of FIG. 22 illustrates a tactile reference projection (300*a*) in the top section (100*a*) and a tactile reference indentation (200*a*) in the bottom section (100*b*), however one skilled in the art will understand that this is merely for simplicity and reference to both section line 2-2 and section line 3-3 in a single figure. The pool cue may include a tactile reference projection (300) in both sections (100*a*, 100*b*), a tactile reference indentation (200) in both sections, or any possible mix of projections (300) and indentations (200) on a single cue stick, including having projections (300) and indentations (200) in the same section (100*a*, 100*b*) but different octants, as is true will all the embodiments herein. One skilled in the art will appreciate that the principles described above with respect to FIGS. 2-9 apply equally to this embodiment. Thus, reference to FIGS. 2-9 are referenced herein merely for illustration of the placement of the tactile reference indentation (200) or projection (300) with respect to the various octants of a handle sections (100*a*, 100*b*). The discussion above with respect to FIGS. 2-9 will not be repeated here but merely referenced as applying to all the embodiments disclosed herein.

In one embodiment the tactile reference indentation (200) or the tactile reference projection (300) located in the bottom section (110*b*) is preferably located within twenty-four inches of the ball-striking tip of the cue stick, and the length (210, 310) is at least six inches. In another embodiment the tactile reference indentation (200) or the tactile reference projection (300) located in the top section (110*a*) is preferably located within twenty-four inches of the butt-end of the cue stick, and the length (210, 310) is at least six inches. A right handed player will typically grip the cue stick with the right hand in the top section (110*a*), while using their left hand to guide the bottom section (110*b*) of the cue stick throughout the stroke. In a further embodiment the tactile reference indentation (200) or projection (300) extends majority of the length of the pool cue with no distinction between a separate indentation or projection in the top section (110*a*) or the bottom section (110*b*).

Generally professional pool players do not rotate the pool cue when making a stroke with the pool cue. However new players almost always rotate the pool cue one direction when pulling back to make a pool shot, and then rotate the pool cue back during the actual pool shot. Unfortunately, the rotation of the pool cue increases the likelihood of inaccurate shots. In addition to all the benefits discussed above, tactile reference indentations (200) and/or tactile reference projections (300) on a pool cue help the pool player become aware of any rotating motion during a pool shot, thereby resulting in a more accurate ball strikes. The tactile reference indentation (200) and/or projection (300) allow the user to deliver the pool cue without rotation and in an exact preselected spot on the cue ball to create the direction and rotation desired. Further, the tactile reference indentation (200) or projection (300) in the bottom section (110*b*) provides the user with a greater sense of whether the stroke of the cue stick is in perfect alignment with the desired direction of ball travel, or if the stroke of the cue stick is cutting across the ball.

Figure 23:
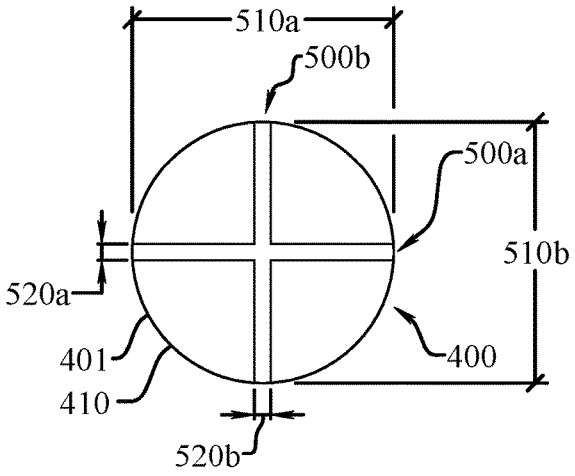
FIG. 23 is a bottom elevation view of a pool cue end cap, not to scale.
Figure 24:
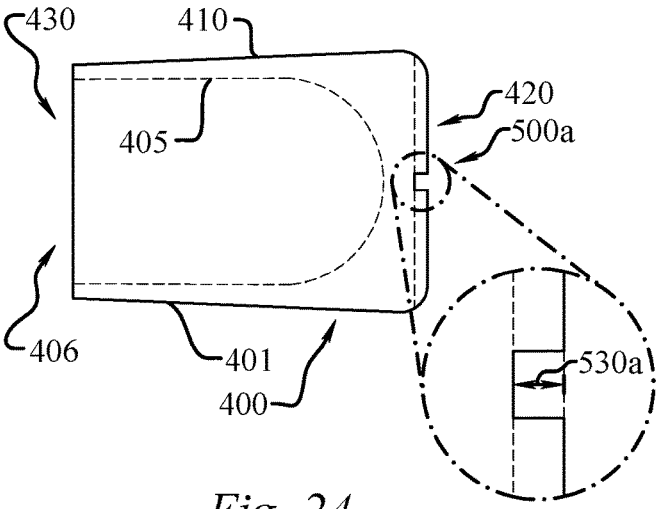
FIG. 24 is a side elevation view of a pool cue end cap, not to scale.
Figure 25:
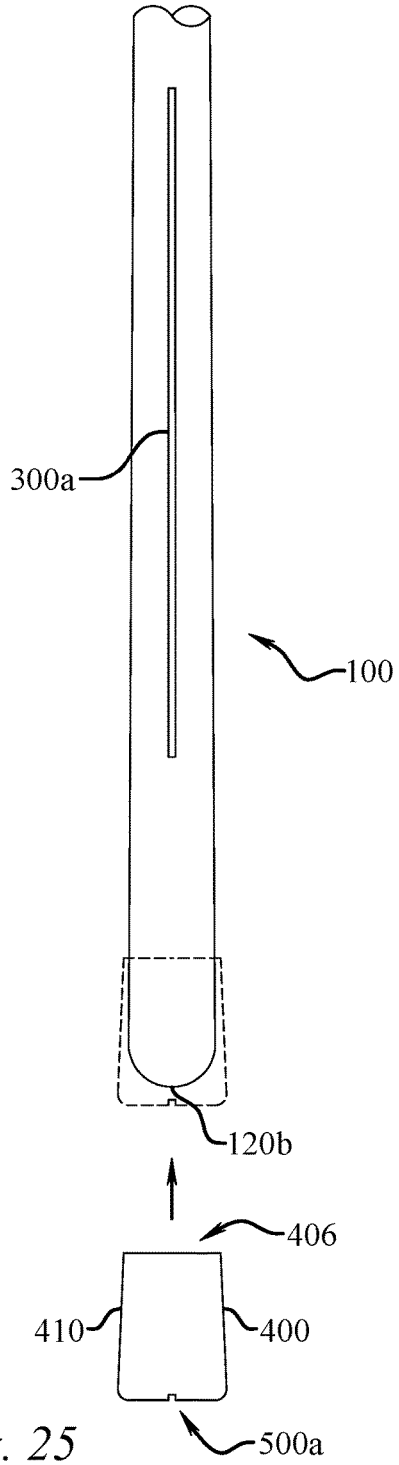
FIG. 25 is a front elevation view of a pool cue end cap and pool cue, not to scale.

The end of a pool cue is illustrated in FIGS. 23-25. The discussion of these figures will reference a pool cue end cap (400) as a separate attachment that may be applied to the end of a pool cue, however one skilled in the art will appreciate that the elements of the end cap (400), namely the pool cue tactile reference indentation (500) or pool cue tactile reference projection, and benefits afforded there from, may also be obtained by the elements being formed directly in the end of the pool cue and are hereby an embodiment of this invention. While separate drawings are not included for the pool cue tactile reference projection, by this point in the disclosure one skilled in the art will understand that the pool cue tactile reference indentation (500) shown in FIGS. 23-25 may just as easily be a projection consistent with the other figures and disclosure.

Some pool players like to wrap a finger, fingers, or even the palm of the hand, around the end of the pool cue when making a shot. In this situation, the pool cue tactile reference indentation (500) or projection gives the player biofeedback regarding the position of the pool cue in the same manner discussed above with respect to other embodiments, thereby helping the player make better shots. The pool cue end cap (400) may have an end cap body (401) having an end cap proximal end (420), an end cap distal end (430), an end cap interior surface (405) and an end cap exterior surface (410). Additionally, the end cap (400) has a pool cue end cap interior aperture (406) located on the pool cue end cap distal end (430). Located on the end cap proximal end (420) is at least end cap tactile reference indentation (500*a*) or projection having an end cap tactile reference indentation length (510*a*); an end cap tactile reference indentation width (520*a*), as seen in FIG. 23; and an end cap tactile reference indentation depth (530*a*) or height, as seen in FIG. 24. The pool cue end cap (400) is installed on a pool cue sports equipment handle (100) by sliding the bottom section proximal end (120*b*) of sports equipment bottom section handle body (101*b*) inside of the pool cue end cap interior aperture (406), as seen in FIG. 25. Another embodiment of the pool cue cap (400) has at least two end cap tactile reference indentations (500*a* and 500*b*) or projections oriented 90 degrees from each other forming an "X" shape pattern as seen in FIG. 23.

Figure 26:
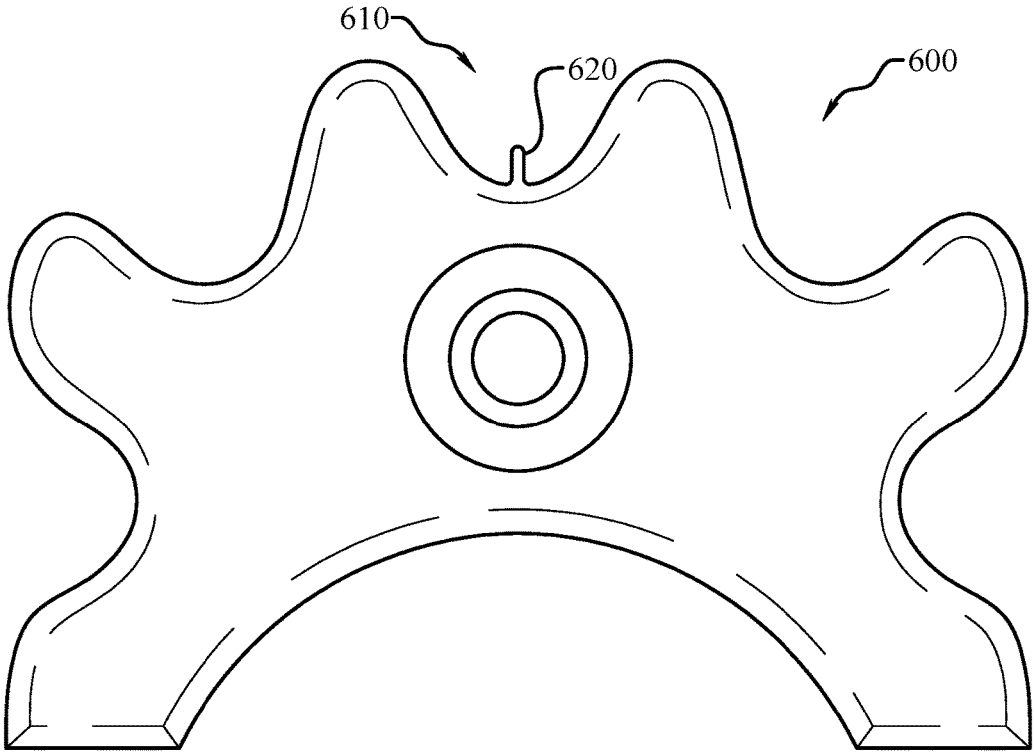
FIG. 26 is an elevation view of a pool cue bridge, not to scale.

Referring now to FIG. 26, is a pool cue bridge (600) including at least one pool cue trough (610) in which a pool cue is slid in a linearly fashion, having a pool cue guidance projection (620). The pool cue guidance projection (610) is inserted into a pool cue's sport equipment handle bottom section (100*b*) tactile reference indentation (200*a*) thereby allowing linear pool cue motion while preventing rotational movement that would throw off a pool shot.

Figure 27:
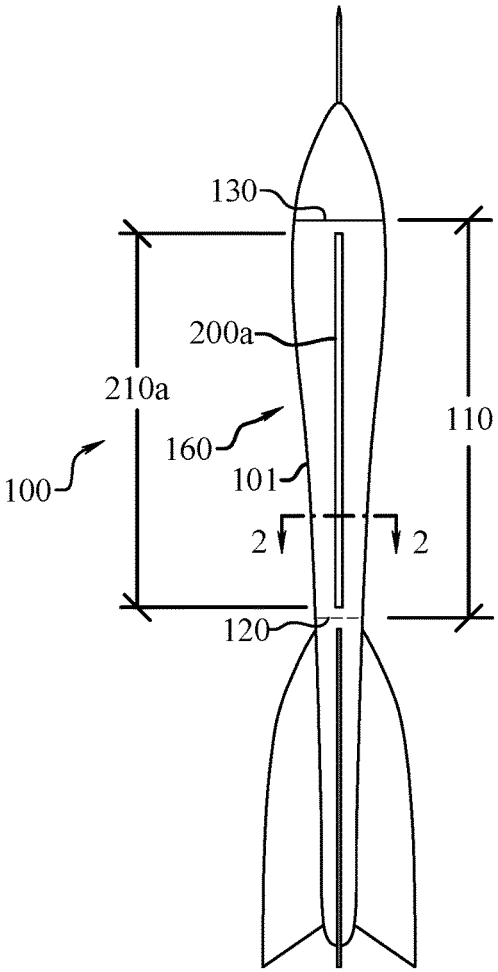
FIG. 27 is a front elevation view of an embodiment of a sports equipment handle on a dart, not to scale.
Figure 28:
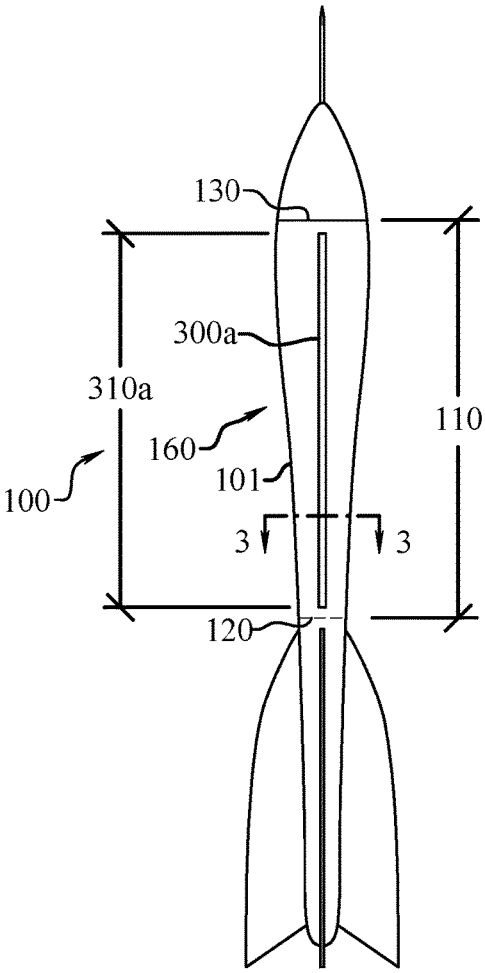
FIG. 28 is a front elevation view of an embodiment of a sports equipment handle on a dart, not to scale.

Referring now to FIG. 27, an embodiment of a sports equipment handle (100) on a throwing dart is illustrated incorporating at least one tactile reference indentation (200*a*). Similarly, FIG. 28 illustrates an embodiment of a sports equipment handle (100) on a throwing dart that incorporates at least one tactile reference projection (300*a*). As with the other disclosed sports equipment handles (100), the throwing dart handle includes a handle body (101) having a handle length (110), a proximal end (120), a distal end (130), and an exterior body surface (160). The tactile reference indentation (200*a*) embodiment of FIG. 27 includes a reference to section line 2-2 and the associated cross-section illustrated in FIG. 2, while the tactile reference projection (300*a*) includes a reference to section line 3-3 and the associated cross-section illustrated in FIG. 3. The disclosure above with respect to at least one tactile reference indentation (200) and/or at least one tactile reference projection (300), the size and placement of them, and the benefits afforded, also apply to this throwing dart embodiment and will not be repeated here for the sake of brevity. Further, although not separately illustrated, throwing dart embodiments may also utilize a tactile reference attachment (700), as would be understood by one skilled in the art in light of the prior disclosure.

When throwing a dart it is important that the dart player release the dart in a linear fashion without rotational or yaw movements. The tactile reference indentations (200) and/or tactile reference projections (300) help the dart player orient the dart during a throw to reduce both rotational and yaw movements, thereby allowing for more accurate throws.

Figure 29:
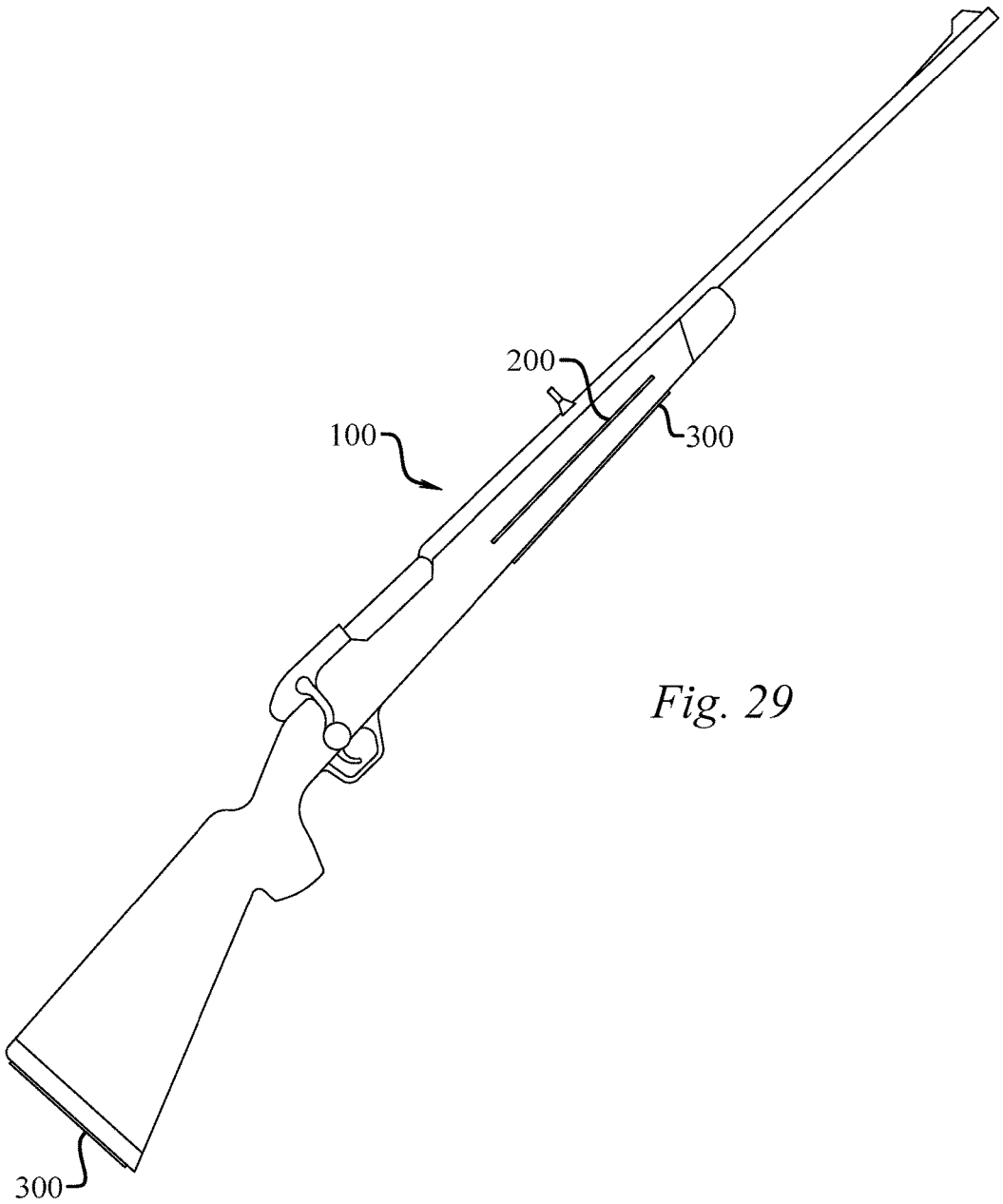
FIG. 29 is an elevation view of an embodiment of a sports equipment handle on a firearm, not to scale.
Figure 39:
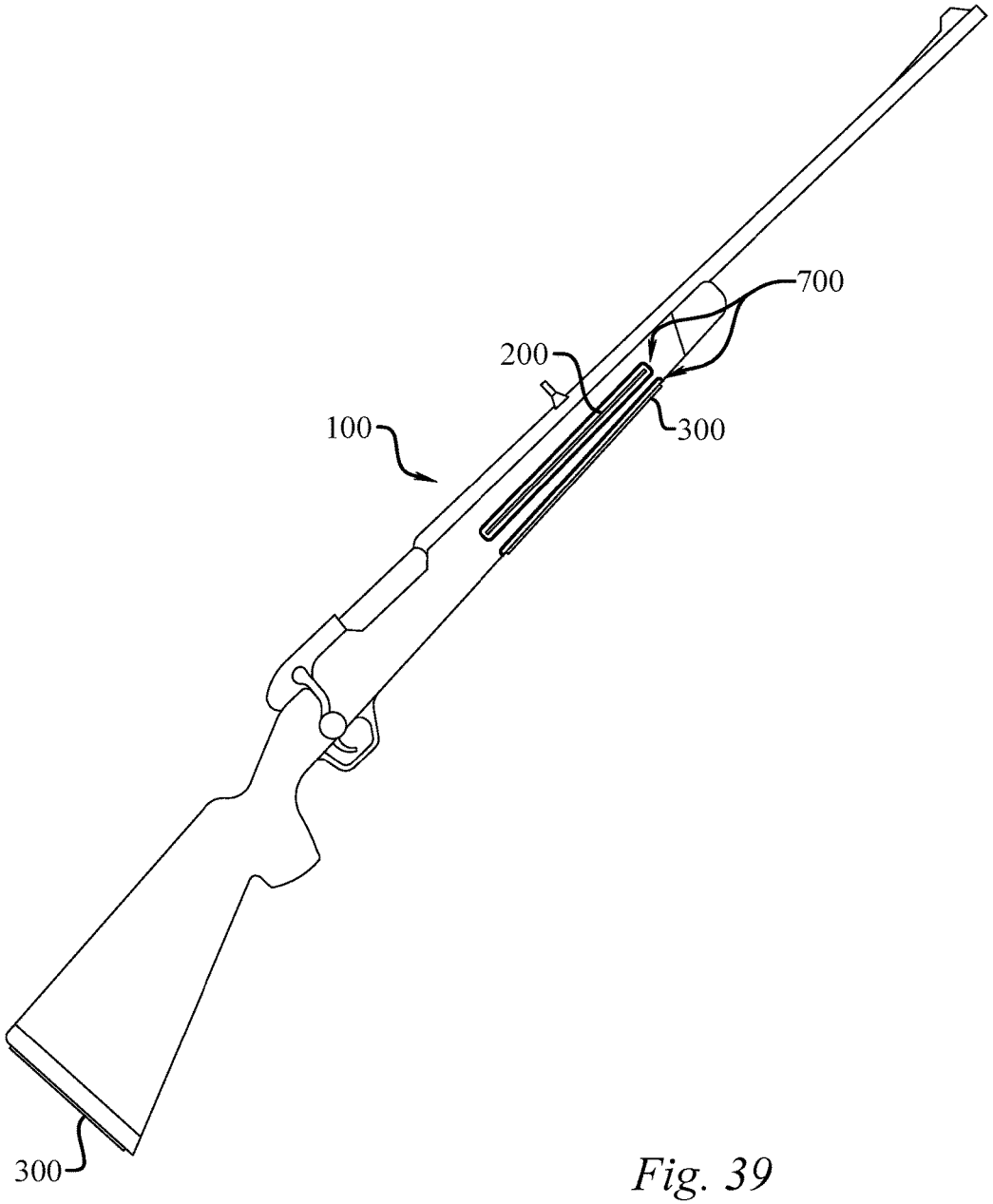
FIG. 39 is an elevation view of an embodiment of a sports equipment handle on a firearm, not to scale.

Referring now to FIGS. 29 and 39, embodiments of a sports equipment handle (100) and a tactile reference attachment (700) on a firearm such as a rifle, shotgun, or cross-bow are illustrated. In this embodiment the tactile reference indentation (200) or projection (300) may be located on the stock, the forestock, trigger, barrel, and/or the butt of the firearm, whether it is permanently formed in a portion of the equipment, or in the form of the tactile reference attachment (700) attached to the equipment. The example of FIG. 29 illustrates both at least one tactile reference indentation (200) and projection (300) in the forestock of the firearm merely for simplicity and reduction of duplicative drawings. As with all the prior embodiments, the sports equipment handle (100) of the firearm includes a handle body (101) having a handle length (110), a proximal end (120), a distal end (130), and an exterior body surface (160). While FIG. 29 does not specifically reference section lines 2-2 and 3-3, it is understood that the tactile reference indentation (200) and/or projection (300) are consistent with FIGS. 2-9 and the disclosure above with respect to size, location, and quantity. Reference to FIGS. 2-9 is not limited to the circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein. In this embodiment the tactile reference indentation (200) or projection (300) on the forestock will only be contacted by a single hand and therefore the length is at least 25 millimeters. The forestock of the firearm may be divided into octants as disclosed above with respect to FIGS. 2-9. Further, as seen in FIGS. 29 and 39, the butt of the firearm may include at least one tactile reference indentation (200) or projection (300) in a manner as similar to that of the pool cue disclosed and illustrated in FIGS. 23-25. Such tactile reference features may be formed directly in the butt end of the stock or in a pad that is attached to the stock. The tactile references of the butt end will be felt on the bare shoulder, or through lightweight clothing, of the shooter. Such firearm tactile reference indentation or projection gives the shooter biofeedback regarding the position and orientation of the firearm in the same manner discussed above with respect to other embodiments, thereby helping the shooter properly position the firearm and make better shots. Another embodiment of the firearm butt tactile reference feature has at least two reference indentations or projections oriented 90 degrees from each other forming an "X" shape pattern as seen in FIG. 23.

One skilled in the art will appreciate that the barrel of a firearm, or cross-bow, has a barrel axis, meaning the path that the projectile will pass within the barrel of the firearm when it is fired. Further, one skilled in the art will recognize that a firearm, whether it has a long barrel or a short barrel like a revolver or pistol, is generally intended to be upright when fired, meaning that a vertical plane passing through the barrel axis will contain the trigger. This is referred to as the design firing position. The vertical plane is then used to define a plane oriented 90 degrees to the vertical plane, which will be referred to as a horizontal plane, although whether it is truly horizontal depends on the orientation of the barrel axis is pitched upward or downward. Thus, the horizontal plane is one that is perpendicular to the vertical plane when in the design firing position and contains the barrel axis. Further, the tactile reference indentation (200) or projection (300) have a reference longitudinal axis, which is a line passing through a centroid of the tactile reference indentation (200) or projection (300) taken at every cross-section taken along the length of the tactile reference indentation (200) or projection (300), which is easily understood by one of skill in the art with respect to FIGS. 2-3. While this description generally makes reference to the long barrel firearm illustrated in FIG. 29, the following frame of reference, nomenclature, and definitions apply equally to short barrel firearms such as the pistols and revolvers discussed herein.

Now, with that frame of reference and nomenclature established, in one embodiment, such as the tactile reference indentation (200) of FIG. 29, the firearm has a tactile reference indentation (200) with a reference longitudinal axis that never intersects the above defined horizontal plane. Thus, in this embodiment the reference longitudinal axis is not necessarily parallel to the barrel axis because the stock may be tapered, but a specific relationship is defined that improves the accuracy of the projectile due to the user's ability to better aim the barrel axis in light of tactile input the user receives from the tactile reference indentation (200), and preferably cannot be visually observed when firing so as not to cause distract from the sight or scope visual targeting. In another embodiment the relationship described in the prior two sentences is achieved with the use of a tactile reference projection (300) rather than a tactile reference indentation (200). Still further, in another embodiment the firearm has at least two tactile reference indentations (200), or projections (300), each having a reference longitudinal axis that never intersects the above defined horizontal plane; which in a further embodiment are located on opposite sides of the barrel, and in yet a further embodiment are located equidistance from the barrel axis. Such embodiments facilitate both left and right handed users, as well as those that cut the stock and contact both tactile reference indentations (200), or projections (300), at the same time. The disclosure of this paragraph applies also to the tactile reference indentation (200), or projection (300), shown on tactile reference attachments (700) in FIG. 45, and one skilled in the art will appreciate that these tactile reference indentations (200), or projections (300), may also be permanently formed in the pistol grip.

In still a further embodiment described with respect to the tactile reference projection (300) illustrated in FIG. 29, the firearm has a tactile reference projection (300) with a reference longitudinal axis that lies within the above defined vertical plane containing the barrel axis and the trigger. This is also true of the tactile reference indentation (200), or projection (300), shown in FIG. 41 as tactile reference attachments (700) on the trigger or trigger guard. Thus, in these embodiments the reference longitudinal axis is not necessarily parallel to the barrel axis because the stock may be tapered, but a specific relationship is defined that improves the accuracy of the projectile due to the user's ability to better aim the barrel axis in light of tactile input the user receives from the tactile reference projection (300), and preferably cannot be visually observed when firing so as not to cause distract from the sight or scope visual targeting. In another embodiment the relationship described in the prior two sentences is achieved with the use of a tactile reference indentation (200) rather than a tactile reference projection (300). An even further embodiment includes at least one tactile reference indentations (200), or projections (300), having a reference longitudinal axis that never intersects the above defined horizontal plane, in addition to at least one tactile reference indentation (200), projection (300), with a reference longitudinal axis that lies within the above defined vertical plane containing the barrel axis and the trigger.

Figure 40:
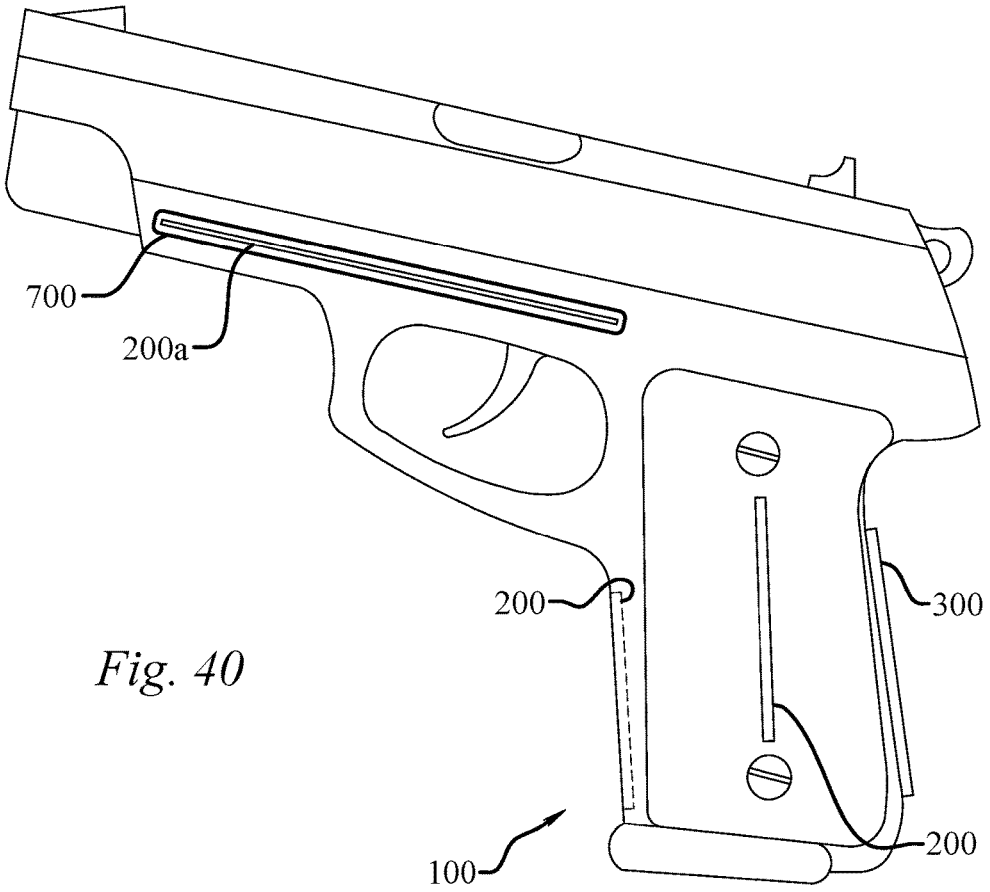
FIG. 40 is an elevation view of an embodiment of a sports equipment handle on a firearm, not to scale.
Figure 41:
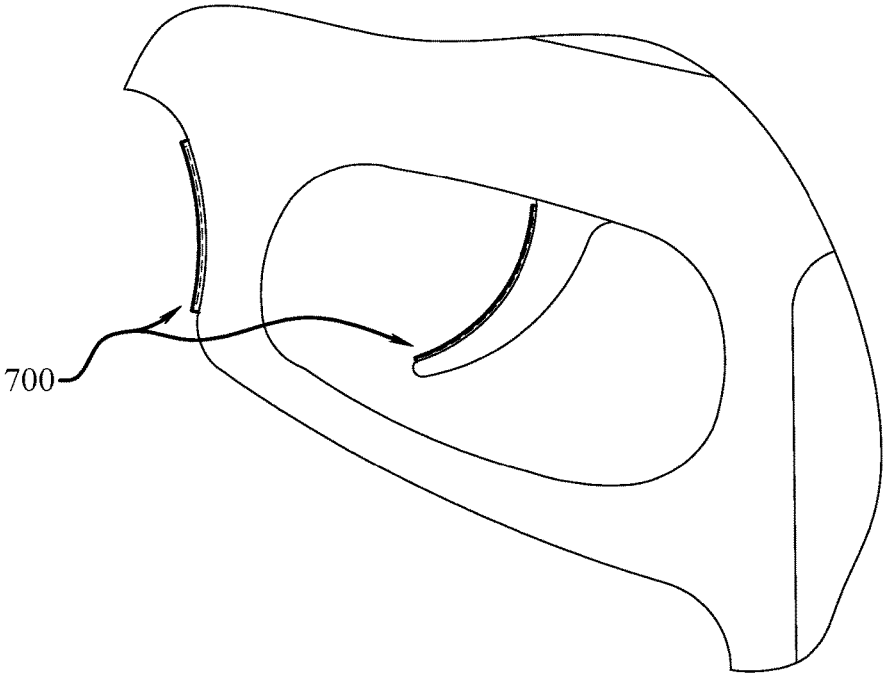
FIG. 41 is an enlarged elevation view of an embodiment of a sports equipment handle on a firearm, not to scale.

The tactile reference indentation (200), or projection (300), may be located adjacent a portion of the barrel such that a projectile passes the tactile reference indentation (200), or projection (300), as seen in FIG. 29, as well as the tactile reference indentation (200*a*) seen in FIG. 40. Similarly, the tactile reference indentation (200), or projection (300), may be located such that the projectile does not pass the tactile reference indentation (200), or projection (300), as is true for the butt end tactile reference projection (300) of FIG. 29, or the grip tactile reference indentation (200), or projection (300), such as those seen in FIGS. 40, 45, 46.

One particular embodiment, seen in FIG. 40, has at least one tactile reference indentation (200*a*), or projection, formed in, or applied to, the body of the firearm, with a reference longitudinal axis that not only (a) never intersects the above defined horizontal plane, but (b) is parallel to the barrel axis. In an even further embodiment the tactile reference indentation length (210*a*), shown in FIG. 1(A) but easily understood with reference to FIG. 40, is at least 20% of the length of the barrel, it is at least 40% of the length of the barrel in another embodiment, is at least 5 times the tactile reference indentation width (220*a*) or tactile reference projection width (320*a*), while at least 10 times in a further embodiment, and at least 20 times in yet another embodiment, which in one embodiment is preferably at least 25 mm, and is at least 50 mm in still another embodiment; and likewise for embodiments having tactile reference projections and a tactile reference projection length (310*a*) seen in FIG. 1(B). In a preferred handgun firearm embodiment the tactile reference indentation length (210*a*), or tactile reference projection length (310*a*) is 5-20 times the tactile reference indentation width (220*a*) or tactile reference projection width (320*a*), and is 7-16 times in another embodiment, and is 9-14 times in yet an even further embodiment. These relationships accommodates the numerous styles of hand positioning and gripping methods used to grasp firearm. Further the tactile reference indentation length, relationship to the width, and position maximize the opportunity for the user's hands and fingers to come into contact with the tactile reference indentation to receive maximum psychomotor tactile biofeedback and provide even more information for processing by the user's natural attributes of sensibility, proprioception, and neuromuscular memory to enable the user to more accurately shoot a projectile.

As previously touched upon, in some embodiments it is desired that the tactile reference indentation (200), or projection (300), cannot be visually observed when firing so as not to cause distract from the sight or scope visual targeting. Thus, in an embodiment the position of the tactile reference indentation (200), or projection (300), is such that a line perpendicular to the floor of the indentation, or the exterior-most surface of the projection, best seen in FIGS. 4 and 5, also referred to as a normal, is oriented downward at an angle of at least 5 degrees. For example, the tactile reference indentations (200*a*, 200*b*) of FIG. 4, and projections (300*a*, 300*b*), are oriented such that the above described normals are perfect horizontal because the tactile reference indentations (200*a*, 200*b*) and projections (300*a*, 300*b*) are located at the 90 degree position and the 270 degree position. In a further embodiment the normal is oriented downward at an angle of at least 10 degrees, while in yet another embodiment it is oriented at 10-45 degrees, and 10-30 degrees in an even further embodiment. Such orientations also serve to enhance the safety of the firearm by encouraging placement of the fingers at the indentation(s) or projection(s), and thus away from the moving components of the firearm.

Figure 30:
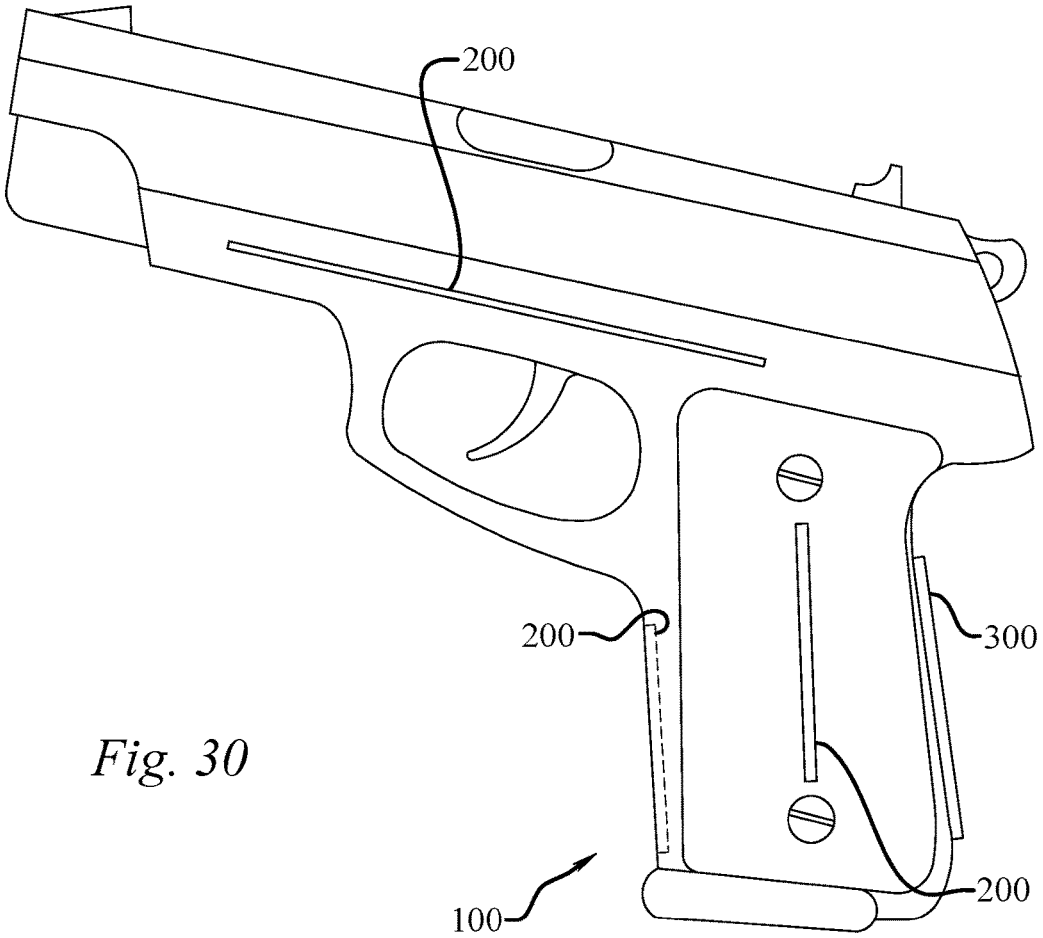
FIG. 30 is an elevation view of an embodiment of a sports equipment handle on a firearm, not to scale.

Referring now to FIGS. 30, 40, 41, 45, and 46, embodiments of a sports equipment handle (100) and a tactile reference attachment (700) on a pistol are illustrated. In these embodiments the tactile reference indentation (200) or projection (300) may be located on the grip, barrel, trigger, or body of the firearm. The example of FIG. 30 illustrates both at least one tactile reference indentation (200) and projection (300) on a single pistol grip, as well as a tactile reference indentation (200) on the body, with a projection not shown but understood to be an embodiment, merely for simplicity and reduction of duplicative drawings. As with all the prior embodiments, the sports equipment handle (100) of the pistol includes a handle body (101) having a handle length (110), a proximal end (120), a distal end (130), and an exterior body surface (160). While FIG. 30 does not specifically reference section lines 2-2 and 3-3, it is understood that the tactile reference indentation (200) and/or projection (300) are consistent with FIGS. 2-9 and the disclosure above with respect to size, location, and quantity. Reference to FIGS. 2-9 is not limited to the circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein. In an embodiment the tactile reference indentation (200) or projection (300) on the pistol, whither permanently formed in a portion of the pistol or attached in the form of a tactile reference attachment (700), has a length of at least 25 millimeters. Such pistol tactile reference indentation or projection gives the shooter biofeedback regarding the position and orientation of the firearm in the same manner discussed above with respect to other embodiments, thereby helping the shooter properly position the pistol and make better shots. An archery bow is held in front of a shooter in a fashion similar to that of a pistol. Therefore, one skilled in the art will appreciate that a tactile reference indentation (200) and/or projection (300) may be incorporated into the handle of a bow to provide the same benefits discussed throughout this application.

The sports equipment handle (100) may be produced from a variety of materials. By way of example only, and not limitation, the sports equipment handle (100) may be constructed of any conventional handle material, such as wood, metal, rubber, synthetic rubber, polymers, composites, and combinations thereof. The hardness of these types of materials is most commonly measured by the Shore (Durometer) test. Shore Hardness, using either the Shore A or Shore D scale, is the preferred method for rubbers/elastomers. The Shore A scale is used for "softer" rubbers while the Shore D scale is used for "harder" ones. The Shore hardness is measured with an apparatus known as a Durometer and consequently is also known as "Durometer hardness." The hardness value is determined by the penetration of the Durometer indenter foot into the sample. The ASTM test method designation is ASTM D2240 00 and is generally used in North America. Related methods include ISO 7619 and ISO 868; DIN 53505; and JIS K 6301, which was discontinued and superceeded by JIS K 6253.

Some of the embodiments disclosed herein, including but not limited to badminton racquet handles, racquetball racquet handles, tennis racquet handles, cricket bat handles, cue sticks, and archery/firearms, the handles may be covered with a grip, often made of a softer leather or synthetic material applied to the handle. Such grips may incorporate the tactile reference indentation (200) and projection (300) disclosed herein. Thus, this disclosure concerning the size and location of the tactile reference indentation (200) and projection (300) applies equally to grips that are then applied over the handles, as well as tactile reference attachments (700) applied over handles and/or grips.

Figure 42:
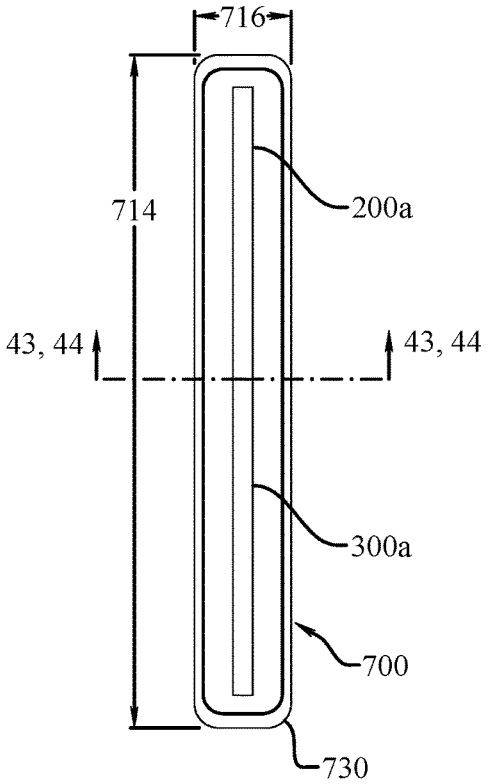
FIG. 42 is an enlarged elevation view of an embodiment of a tactile reference attachment, not to scale.
Figure 43:
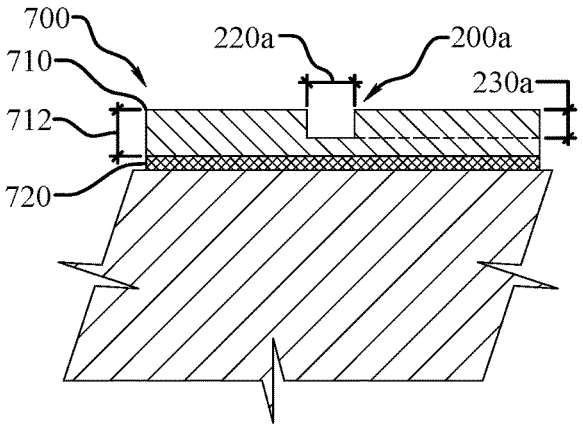
FIG. 43 is a cross-section of an embodiment of a tactile reference attachment, not to scale.
Figure 44:
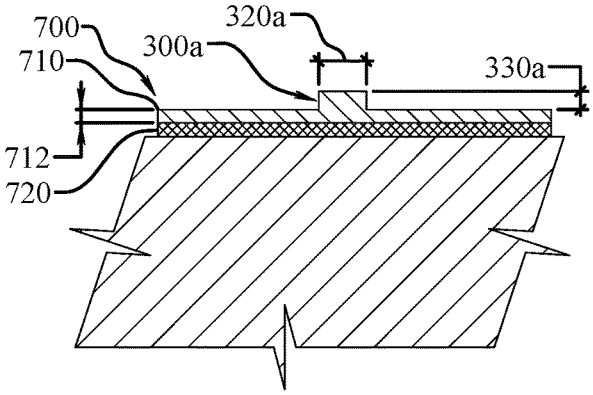
FIG. 44 is a cross-section of an embodiment of a tactile reference attachment, not to scale.

As previously touched upon, the aforementioned tactile reference indentation (200) or tactile reference projection (300) may be formed in a piece of equipment, or may be attached to the equipment via a tactile reference attachment (700) having at least one tactile reference indentation (200) or at least one tactile reference projection (300), as seen in FIGS. 31-46. In one embodiment the tactile reference attachment (700) includes a primary substrate (710) containing the at least one tactile reference indentation (200*a*) or at least one tactile reference projection (300*a*), as seen in FIGS. 42-44. A benefit of the tactile reference attachment (700) embodiments is that the user may precisely position the tactile reference attachment (700), and therefore one or more tactile reference indentations (200*a*) or tactile reference projections (300*a*), on a piece of equipment wherever desired. This allows a user to test many different locations and configurations on a single existing piece of equipment to determine that which provides the greatest performance benefit for them, thereby eliminating the expense of multiple pieces of custom equipment or handles.

In embodiments directed to non-swinging, or throwing, equipment, the tactile reference attachment (700) may consist of only a primary substrate (710) having the at least one tactile reference indentation (200*a*) or at least one tactile reference projection (300*a*). In such embodiments the tactile reference attachment (700) is not subjected to significant forces when gripped by the user and therefore may stay in place and provide the described benefits when in the form of a static cling decal, having the disclosed indentation or projection attributes, that can easily be applied, removed, and reapplied.

Referring again to FIGS. 42-44, the tactile reference attachment (700) includes a primary substrate (710), which may be flexible or rigid. The primary substrate (710) has a primary substrate thickness (712), a primary substrate length (714), and a primary substrate width (716). The primary substrate thickness (712) is at least 25% greater than the first tactile reference indentation depth (230*a*) or the primary substrate thickness (712) is at least 25% greater than the first tactile reference projection height (330*a*), while in a further embodiment it is at least 33% greater than the first tactile reference indentation depth (230*a*) or it is at least 33% greater than the first tactile reference projection height (330*a*), and in yet an even further embodiment it is at least 50% greater than the first tactile reference indentation depth (230*a*) or it is at least 50% greater than the first tactile reference projection height (330*a*). Another series of embodiments caps the primary substrate thickness (712) so as to not negatively influence the performance of the equipment or become distracting to the user. In one such embodiment the primary substrate thickness (712) is less than twice the first tactile reference indentation depth (230*a*) or first tactile reference projection height (330*a*). Additionally, a relationship of the primary substrate thickness (712) in relation to the first tactile reference indentation width (220*a*), or first tactile reference projection width (320*a*), is important to ensure the tactile perception of the indentation or projection is not negatively influenced by the primary substrate thickness (712). In one such embodiment the primary substrate thickness (712) is no more than twice the first tactile reference indentation width (220*a*), or the primary substrate thickness (712) is no more than twice the first tactile reference projection width (320*a*); while in another embodiment it is no more than 50% greater than the first tactile reference indentation width (220*a*), or it is no more than 50% greater than the first tactile reference projection width (320*a*); and in still a further embodiment it is no greater than the first tactile reference indentation width (220*a*), or it is no greater than the first tactile reference projection width (320*a*). However, durability may become an issue when primary substrate thickness (712) is significantly less than the first tactile reference indentation width (220*a*), or first tactile reference projection width (320*a*), thereby becoming a tear strip. Thus, in one particularly durable embodiment the primary substrate thickness (712) is at least 25% of the first tactile reference indentation width (220*a*), or the primary substrate thickness (712) is at least 25% of the first tactile reference projection width (320*a*), while in another embodiment it is at least 40% of the first tactile reference indentation width (220*a*), or it is at least 40% of the first tactile reference projection width (320*a*), and in yet a further embodiment it is at least 55% of the first tactile reference indentation width (220*a*), or it is at least 55% of the first tactile reference projection width (320*a*). In one specific embodiment the primary substrate thickness (712) is no greater than 4.0 mm, while in another embodiment it is no greater than 3.0 mm, in yet another embodiment it is 0.75-2.5 mm, while in an even further embodiment it is 1.0-2.0 mm. In one embodiment the tactile reference projection (300*a*) is formed integrally with the primary substrate (710), while in another embodiment the tactile reference projection (300*a*) is attached to, or inserted into, the primary substrate (710).

In some embodiments the primary substrate width (716), seen in FIG. 42, is such that the edges of the at least one tactile reference indentation (200*a*), or at least one tactile reference projection (300*a*), are separated from an edge of the primary substrate (710) by an edge clearance distance that is at least as great as the first tactile reference indentation width (220*a*), or first tactile reference projection width (320*a*), to ensure that the user is sensing the indentation or projection, and not an edge of the primary substrate (710). In a further embodiment the edge clearance distance is at least 50% greater than the first tactile reference indentation width (220*a*), or first tactile reference projection width (320*a*). While in even further embodiments this goal is achieve by varying the primary substrate thickness (712) so that at the perimeter edges of the primary substrate (710) the primary substrate thickness (712) is reduced to less than 0.5 mm, thereby making the edges unperceivable to the average human fingers; thus in a further embodiment the primary substrate thickness (712) changes by at least 50% from the perimeter edges to the first tactile reference indentation width (220*a*), or first tactile reference projection width (320*a*). The stability of the tactile reference attachment (700) and its ability to maintain a straight tactile reference indentation (200*a*), or tactile reference projection (300*a*), despite repeated gripping or contact with the user's fingers, is improved in embodiments having an aspect ratio of the primary substrate length (714) to the primary substrate width (716) that is no more than The tactile reference attachment (700) may also include an adhesive (720), as well as a release liner (730). The adhesive (720) may a permanent adhesive or a multi-use adhesive so that the tactile reference attachment (700) may be repeatedly attached and removed from a piece of equipment, or used on multiple pieces of equipment. The release liner (730) may protect the adhesive (720) until the tactile reference attachment (700) is about to be attached to a piece of equipment. In a further embodiment majority of the tactile reference attachment (700) has a rough surface with an average roughness (Sa) value of 15-125 μm. In still a further embodiment the rough surface does not extend to an edge of the tactile reference indentation (200*a*), or tactile reference projection (300*a*); in fact in one embodiment the rough surface does not get within a smooth region dimension of an edge of the tactile reference indentation (200*a*), or tactile reference projection (300*a*), and the smooth region dimension is at least as great as the first tactile reference indentation width (220*a*), or first tactile reference projection width (320*a*). In a further embodiment the smooth region dimension is at least as great as twice the first tactile reference indentation width (220*a*), or first tactile reference projection width (320*a*).

Figure 45:
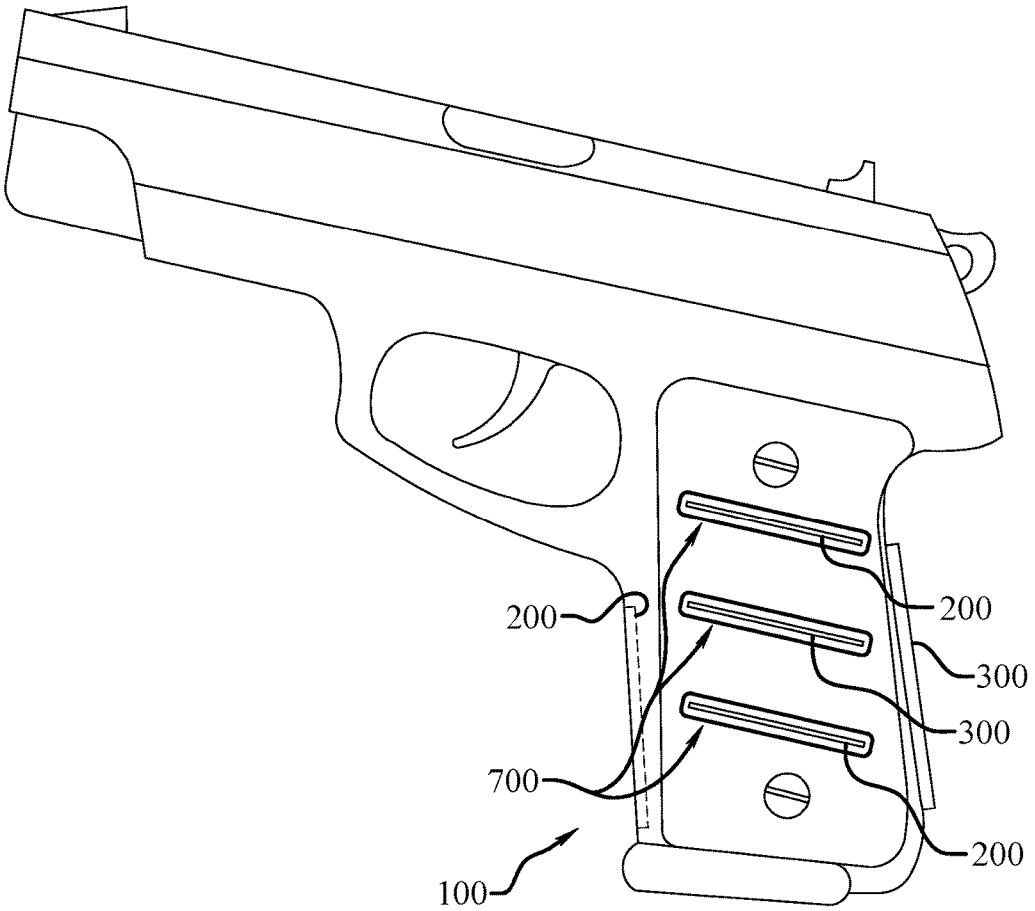
FIG. 45 is an elevation view of an embodiment of a sports equipment handle on a firearm, not to scale.
Figure 46:
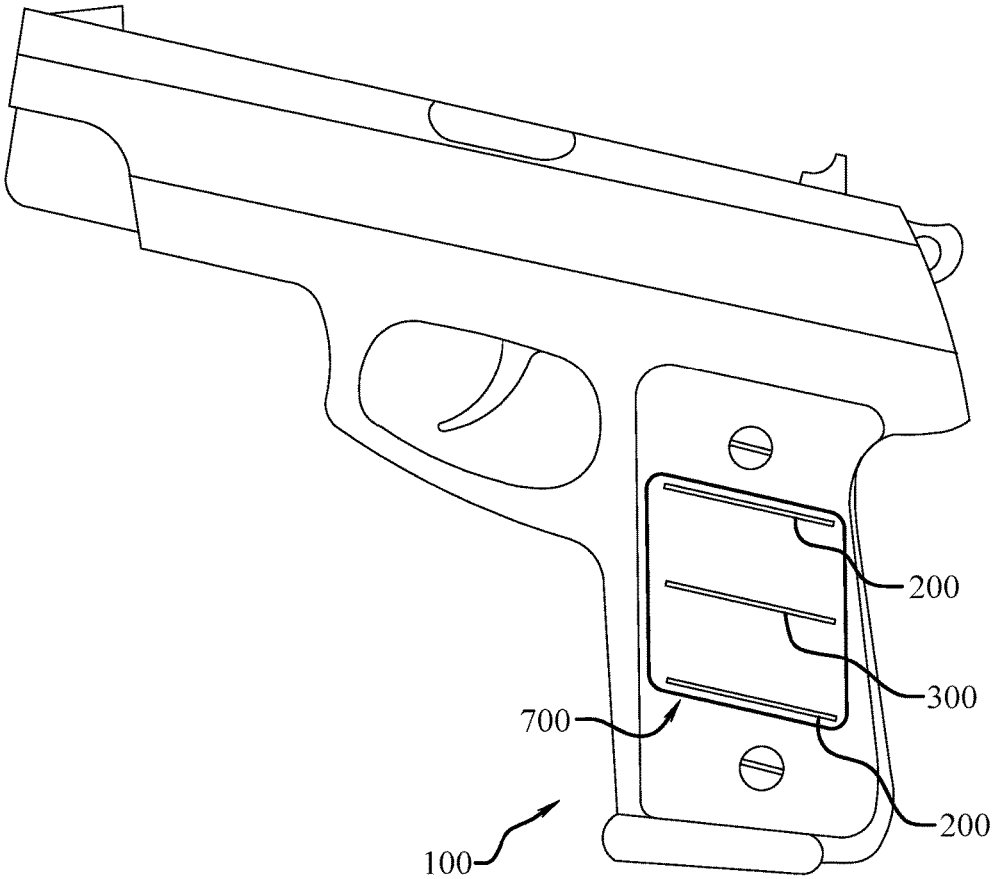
FIG. 46 is an elevation view of an embodiment of a sports equipment handle on a firearm, not to scale.

Some embodiments of the tactile reference attachment (700) contain only a single tactile reference indentation (200*a*), or tactile reference projection (300*a*), per tactile reference attachment (700), as seen in FIG. 45. Conversely, in other embodiments the tactile reference attachment (700), such as the one seen in FIG. 46, incorporate multiple tactile reference indentations (200*a*), or tactile reference projections (300*a*), per tactile reference attachment (700). Embodiments such as that seen in FIG. 46 are beneficial in that the tactile reference attachment (700) controls the spacing and relative orientation of the multiple tactile reference indentations (200*a*), or tactile reference projections (300*a*), so as to avoid conflicting feedback.

The palm side of the human hand has a durometer value ranging from approximately 25 to approximately 35 Shore A on the hardness scale. In yet another embodiment, the durometer of the sports equipment handle (100), the tactile reference indentation (200), and/or the tactile reference projection (300) is at least 70 percent greater than the durometer value of the palm side of the human hand. Thus, in one embodiment the sports equipment handle (100), the tactile reference indentation (200), and/or the tactile reference projection (300) has a durometer value greater than 60 Shore A on the hardness scale to ensure that the sports equipment handle (100), the tactile reference indentation (200), and/or the tactile reference projection (300) is significantly harder than the portion of the human hand, and therefore the tactile reference indentation and/or projection is even more perceivable. In an even further embodiment the sports equipment handle (100) has a durometer value of at least 65 Shore A on the hardness scale to ensure that the sports equipment handle (100) is significantly harder than the portion of the human hand.

Thus, one skilled in the art will appreciate that an even further embodiment consists of at least one tactile reference projection (300) that may be applied to the handle of a preexisting piece of sports equipment. For instance, one embodiment may incorporate a kit of one or more one tactile reference projections (300) that may be adhered to the handle of an ordinary piece of sports equipment. For example, a user may apply a tactile reference projection (300) to the handle of a standard baseball bat, or any other piece of sports equipment, to determine if the addition of the tactile reference projection (300) improves their ball striking, throwing, or shooting. Alternatively, the tactile reference indentation (200) or projection (300) may be formed in the handle of piece of sports equipment utilizing traditional handle manufacturing processes.

In the case of a grip applied over a handle, or a nonmetallic handle, the grip, handle, or tactile reference indentation (200) or projection (300) may be made of rubber, synthetic rubber or polymers, which may be produced by injection molding or extrusion molding. Often conventional handle molding techniques are limited in their ability to produce a sports equipment handle (100) having a tactile reference indentation (200*a*) or a tactile reference projection (300*a*) with distinct sharp edges, i.e., zero radius edges. Therefore, the sports equipment handle (100) may be formed by a molding process followed by a CNC machining process. Additionally, the sports equipment handle (100) may be produced by an advanced compression molding process, laser cutting, or a water jet. Furthermore, a sports equipment handle (100) that is made out of wood, metal, or composites, and combinations thereof may be formed by CNC machining, laser cutting, and or water jet cutting to form the basic shape of the sports equipment handle (100) and any tactile reference indentations (200) or tactile reference projections (300) found thereon.

Thus far the disclosure has included baseball bat embodiments, ping pong paddle embodiments, badminton racquet embodiments, tennis racquet embodiments, racquetball racquet embodiments, cricket bat embodiments, pool cue embodiments, dart embodiments, and archery/firearm embodiments; one skilled in the art will appreciated that the disclosure applies equally to the squash racquets, curling stone handles, pole vaulting pole handles, lacrosse stick handles, handles for water sport paddles and oars such as kayak, rowing, and canoe paddle handles, fishing rod handles and grips, fly fishing rod handles and grips, bicycle, motorcycle and snowmobile handles and grips, discuses, javelins, hammers, shoes, skates, weight lifting bars, rhythmic gymnastics sticks, juggling pins and balls, flying disks, throwing axes and knives, fencing handles, which are included herein without the need for repetitive discussion. Numerous alterations, modifications, and variations of the preferred embodiments disclosed herein will be apparent to those skilled in the art and they are all anticipated and contemplated to be within the spirit and scope of the sports equipment handle (100) or contact surface, as in the case of shoes and skates. One skilled in the art will recognize how one or more indentations or projections may be formed in, or attached to, the interior of a shoe or skate to improve an athletes sense of where their foot is in space, which is particularly beneficial in dance, ballet, field and track, soccer, and ice skating, to just name a few. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the sports equipment handle (100) are described herein, it is to be understood that the practice of such additional modifications and variations and the equivalents thereof, are within the spirit and scope of the invention.

I claim:

1. A firearm comprising:

a body having a barrel, a trigger, and a trigger guard, wherein the barrel has a longitudinal barrel axis and a barrel length, and in a designed firing position a vertical plane contains the barrel axis and a portion of the trigger, and further defines a horizontal plane oriented perpendicular to the vertical plane and containing the barrel axis;

at least a first tactile reference indentation extending along a portion of the body and having a tactile reference longitudinal axis, a first tactile reference indentation width of at least 2.0 millimeters and no greater than 5.0 millimeters, a first tactile reference indentation depth of at least 0.5 millimeters and no greater than the first tactile reference indentation width, and a first tactile reference indentation length that is at least five times the first tactile reference indentation width;

wherein the reference longitudinal axis does not intersect the horizontal plane, and the first tactile reference indentation provides a user with tactile biofeedback by two-point discrimination when aiming and firing the firearm;

wherein the first tactile reference indentation is formed in a tactile reference attachment that is releasably attached to an exterior surface of the firearm, and the first tactile reference indentation is stationary with respect to the trigger guard as the firearm is fired; and wherein the tactile reference attachment is flexible and includes an adhesive to secure the tactile reference attachment to the firearm, with the tactile reference attachment having a primary substrate having a primary substrate thickness that is at least 25% greater than the first tactile reference indentation depth.

2. The firearm of claim 1, wherein the first tactile reference indentation length is at least seven times the first tactile reference indentation width.

3. The firearm of claim 2, wherein the first tactile reference indentation length is no more than twenty times the first tactile reference indentation width.

4. The firearm of claim 2, wherein the first tactile reference indentation length is at least 20% of the barrel length.

5. The firearm of claim 4, wherein the first tactile reference indentation length is at least 40% of the barrel length.

6. The firearm of claim 1, wherein majority of the substrate exterior surface has a rough surface with an average roughness (Sa) value of 15-125 μm.

7. The firearm of claim 1, wherein the first tactile reference indentation of the flexible tactile reference attachment has a durometer value greater than 60 Shore A.

8. The firearm of claim 1, wherein the tactile reference attachment further includes a second tactile reference indentation extending along the body and having a second tactile reference longitudinal axis parallel to the barrel axis and located on the opposite side of the barrel axis from the first tactile reference indentation, a second tactile reference indentation width of at least 2.0 millimeters and no greater than 5.0 millimeters, a second tactile reference indentation depth of at least 0.5 millimeters and no greater than the second tactile reference indentation width, and a second tactile reference indentation length that is at least five times the second tactile reference indentation width.

9. The firearm of claim 1, wherein the firearm is a pistol having a grip and the tactile reference attachment is located on the grip.

10. A firearm comprising:

a body having a barrel, a trigger guard, and a trigger, wherein the barrel has a longitudinal barrel axis and a barrel length, wherein in a designed firing position a vertical plane contains the barrel axis and a portion of the trigger, and a horizontal plane is oriented perpendicular to the vertical plane and contains the barrel axis;

a tactile reference attachment that is releasably attached to the firearm and includes a primary substrate having a plurality of attachment perimeter edges, a substrate exterior surface, a primary substrate thickness, and at least a first tactile reference indentation having a plurality of indentation perimeter edges, a tactile reference longitudinal axis, a first tactile reference indentation width of at least 2.0 millimeters and no greater than 5.0 millimeters, a first tactile reference indentation depth of at least 0.5 millimeters and no greater than the first tactile reference indentation width, and a first tactile reference indentation length that is at least five times the first tactile reference indentation width, wherein (i) the tactile reference attachment is flexible, while the first tactile reference indentation has a durometer value greater than 60 Shore A, and includes an adhesive to secure the tactile reference attachment to the firearm, (ii) the primary substrate thickness is no more than twice the first tactile reference indentation width, and (iii) the primary substrate thickness is no more than twice the first tactile reference indentation depth; and wherein the tactile reference attachment is stationary with respect to the trigger guard.

11. The firearm of claim 10, wherein the first tactile reference indentation length is no more than twenty times the first tactile reference indentation width.

12. The firearm of claim 10, wherein the firearm is a pistol having a grip and the tactile reference attachment is located on the grip.

13. The firearm of claim 10, wherein the firearm is a pistol and the tactile reference attachment is located on the barrel.

14. The firearm of claim 10, wherein the each of the plurality of indentation perimeter edges is separated from the nearest attachment perimeter edge by an edge clearance distance, and the smallest edge clearance distance is at least 50% greater than the first tactile reference indentation width.

15. The firearm of claim 14, wherein the primary substrate thickness varies by at least 50% from at least one of the plurality of attachment perimeter edges to at least one of the plurality of indentation perimeter edges.

16. The firearm of claim 10, wherein majority of the substrate exterior surface has a rough surface with an average roughness (Sa) value of 15-125 μm.

17. The firearm of claim 16, wherein the rough surface is separated from all of the plurality of indentation perimeter edges by a smooth region dimension that is at least as great as the first tactile reference indentation width.

18. The firearm of claim 17, wherein the tactile reference attachment has a single first tactile reference indentation.

19. The firearm of claim 10, wherein the tactile reference attachment further includes a second tactile reference indentation substantially parallel to the first tactile reference indentation and having a second tactile reference longitudinal axis, a second tactile reference indentation width of at least 2.0 millimeters and no greater than 5.0 millimeters, a second tactile reference indentation depth of at least 0.5 millimeters and no greater than the second tactile reference indentation width, and a second tactile reference indentation length that is at least five times the second tactile reference indentation width.

* * * * *